US006403294B2

(12) United States Patent
Sato

(10) Patent No.: US 6,403,294 B2
(45) **Date of Patent: *Jun. 11, 2002**

(54) SILVER HALIDE PHOTOGRAPHIC MATERIAL

(75) Inventor: Tadanobu Sato, Kanagawa (JP)

(73) Assignee: Fuji Photo Film Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/431,256

(22) Filed: Nov. 1, 1999

(30) Foreign Application Priority Data

| | | |
|---|---|---|
| Nov. 4, 1998 | (JP) | 10-313381 |
| Dec. 25, 1998 | (JP) | 10-371213 |
| Feb. 15, 1999 | (JP) | 11-036106 |
| Aug. 30, 1999 | (JP) | 11-243347 |
| Aug. 30, 1999 | (JP) | 11-243348 |

(51) Int. Cl.[7] ..... G03C 1/005

(52) U.S. Cl. ..... 430/567; 430/569; 430/600; 430/604; 430/605

(58) Field of Search ..... 430/567, 569, 430/600, 604, 605

(56) References Cited

U.S. PATENT DOCUMENTS

| | | | | | |
|---|---|---|---|---|---|
| 5,360,712 | A | | 11/1994 | Olm et al. | 430/567 |
| 5,728,516 | A | * | 3/1998 | Edwards et al. | 430/567 |
| 5,759,758 | A | * | 6/1998 | Yamazaki et al. | 430/567 |
| 5,783,373 | A | * | 7/1998 | Mydlarz et al. | 430/604 |
| 5,821,044 | A | * | 10/1998 | Bergthaller et al. | 430/373 |
| 6,001,543 | A | * | 12/1999 | Asami et al. | 430/351 |

* cited by examiner

*Primary Examiner*—Richard L. Schilling
*Assistant Examiner*—Amanda C. Walke
(74) *Attorney, Agent, or Firm*—Sughrue Mion, PLLC

(57) ABSTRACT

A silver halide photographic material is disclosed, comprising a support having thereon at least one silver halide emulsion layer, wherein said silver halide emulsion comprises a metal complex in which a majority of coordination sites of the metal ion is occupied by ligands containing a chain or cyclic hydrocarbon as a parent compound, or ligands in which carbon atoms or hydrogen atoms in the chain or cyclic hydrocarbon as a parent compound are partially replaced by other atoms or atomic groups.

17 Claims, No Drawings

SILVER HALIDE PHOTOGRAPHIC MATERIAL

FIELD OF THE INVENTION

The present invention relates to a silver halide photographic material and, more particularly, to a high speed silver halide photographic material utilizing the technique of dopants.

BACKGROUND OF THE INVENTION

As one of the techniques of modifying silver halide grains to bring about as much improvement as is expected in the properties of a silver halide photographic material as a whole, there is known a technique of incorporating a substance (dopant) other than silver and halide ions into silver halide grains. This technique is referred to as "a doping technique". In particular, many researches on the techniques of doping transition metal ions have been made. As a result, it is generally recognized that the transition metal ions incorporated as a dopant into silver halide grains can effectively modify photographic properties even when the amount thereof is minute.

Besides the technique of doping transition metal ions, there is known the technique of doping silver halide grains with transition metal complexes having cyanide ions as ligands to heighten the sensitivity of silver halide emulsions. In particular, many disclosures have been made about the emulsions having sensitivities increased by doping with the group VIII metal complexes containing 6 cyanide ions as ligands. As the dopants containing cyanide ions, for instance, a hexacyanoferrate (II) complex and a hexacyanoferrate(III) complex are disclosed in JP-B-48-35373 (the term"JP-B" as used herein means an "examined Japanese patent publication"). However, the invention cited above regards the sensitivity increasing effect as being limited to the cases of complex salts containing iron ion and having no relation to the species of ligands. Many other cases are known where high sensitivity can be conferred on emulsions by doping them with hexacyanoferrate(II) complexes. Such cases are disclosed, e.g., in JP-A-5-66511 (the term "JP-A" as used herein means an "unexamined published Japanese application") and U.S. Pat. No. 5,132,203. There are also known the emulsions which are doped with cyano-complexes of metals other than iron to obtain high sensitivity. For instance, JP-A-2-20853 discloses that silver halide emulsions can acquire high sensitivity by comprising silver iodochloride doped with a rhenium, ruthenium, osmium or iridium complex. Many of other metal ion complexes are also used as dopant, and can produce not only the sensitivity increasing effect but also various effects, such as an improvement in reciprocity failure and an increase in contrast. For instance, U.S. Pat. No. 2,448,060 discloses the emulsions sensitized by doping them with a platinum or palladium(III) complex having halogen ions as ligands. And U.S. Pat. No. 3,790,390 discloses the emulsions doped with cyano-cobalt (III) complexes in addition to the emulsions doped with cyano-iron(II) or cyano-iron(III) complexes, wherein spectral sensitizing dyes are also contained. Further, the silver halide grains formed in the presence of a rhodium (III) complex containing 3, 4, 5 or 6 cyanide ions as ligands are disclosed in U.S. Pat. No. 4,847,191. Those patent prove that the high intensity failure can be diminished by dopants. In European Patents 0335425 and 0336426 and JP-A-2-20854 are disclosed the silver halide emulsions doped with rhenium, ruthenium, osmium or iridium complexes having at least 4 cyano-ligands. Therein, it is described that the doped emulsions are improved in storage stabilities of sensitivity and gradation and reduced in low intensity failure. European Patent 0336427 and JP-A-2-20852 disclose the silver halide emulsions respectively using vanadium, chromium, manganese, iron, ruthenium, osmium, rhenium and iridium complexes having the coordination number of 6 and containing nitrosyl or thionitrosyl ligands, wherein the low intensity reciprocity failure is improved without attended by lowering of medium illumination sensitivity. As the dopants other than transition metal ions, the emulsions doped with bismuth or lead ions are disclosed in U.S. Pat. No. 3,690,888, and the emulsions containing the group XIII or XIV metal ions are disclosed in JP-A-7-128778.

With respect to the ligands of complexes used as dopant, the cyanide ions are regarded as most popular, but halide ions are also used frequently. As examples of a dopant having the structure of $[MCl_6]^{n-}$ wherein M is a metal, mention may be made of the hexachlororuthenium, hexachloroiridium and hexachlororhenium complexes disclosed, e.g., in JP-A-63-184740, JP-A-1-285941, JP-A-2-20852 and JP-A-2-20855. Further, the six-coordinated rhenium complexes having halogeno, nitrosyl, thionitrosyl, cyano, aquo or/and thiocyano ligands are disclosed as dopants in European Patent 0336689 and JP-A-2-20855. In addition, the emulsion containing a six-coordinated transition metal complex having one carbonyl ligand and the emulsion containing a six-coordinated transition metal complex having two oxo ligands are disclosed as those having useful photographic properties in JP-A-3-118535 and JP-A-3-118536 respectively. Furthermore, the cases of using as dopant the complexes containing heterocyclic compounds as ligands are disclosed in U.S. Pat. Nos. 5,360,712, 5,457,021 and 5,462,849, European Patent 0709724, JP-A-7-72569 and JP-A-8-179452.

However, the complexes used as dopant in U.S. Pat. No. 5,360,712 require that at least half of the coordination sites of the central metal ion be occupied with halogen or pseudo-halogen ions. On the other hand, the cases of using as dopant the complexes wherein neither halogen nor pseudo-halogen ions are bound to the coordination sites of their respective metal ions, such as $[Fe(EDTA)]^{2-}$ (wherein EDTA represents ethylene-diaminetetraacetic acid) and $[Ir(C_2O_4)_3]^{3-}$, are disclosed in U.S. Pat. No. 3,672,901, JP-A-2-259749 and JP-A-4-336537. However, U.S. Pat. No. 5,360,712 cited above describes that those complexes are not effective as dopants. In addition, the technique of including groups capable of adsorbing to silver halide grains in the organic compounds used as ligands is disclosed in JP-A-11-102042. No cases but the above-recited ones are yet known where the complexes having neither halogen nor pseudo-halogen ions bound to their coordination sites are used as dopants.

In order that the emulsions acquire high speed, they are required to undergo chemical sensitization besides the addition of dopants. In the case where the emulsion doped with a cyano-complex is subjected to gold sensitization as typical of chemical sensitization, as described, e.g., in JP-A-8-62761, the cyanide ions liberated from the complex are adsorbed to the silver halide grain surface and form a cyano-gold complex together with the gold ion added as a gold sensitizer, thereby inhibiting the formation of sensitized center by the gold sensitizer. In order to effect gold sensitization of the emulsion containing a cyano-complex as dopant, it is required to keep the cyano groups away from the silver halide grain surface, e.g., by making the cyano-complex dope the sub-surface of silver halide grains as described in U.S. Pat. No. 5,132,203 and European Patent 0508910. As another preventive against the inhibition of gold sensitization, there is known the method of adding zinc ion or the like as disclosed in JP-A-6-308653. As mentioned above, a further measure must be taken in order to achieve both an increase of photographic speed by the dopant and gold sensitization.

Most of the dopants hitherto known to enable the increase of photographic speed are cyano-complexes. These cyano-complexes still have a toxicity problem common to cyan compounds even if their problem of inhibiting gold sensitization can be overcome. Therefore, new dopants containing no cyanide ions and capable of imparting high speed to emulsions have been awaited.

SUMMARY OF THE INVENTION

An object of the present invention is to provide a silver halide photographic material containing no cyanide ions but having a higher photographic speed than ever.

The foregoing object of the invention is attained by a silver halide photographic material according to any of Embodiments (1) to (33) described below:

(1) A silver halide photographic material comprising a support having thereon at least one silver halide emulsion layer, wherein the silver halide emulsion comprises a metal complex in which a majority of coordination sites of the metal ion is occupied by ligands containing a chain or cyclic hydrocarbon as a parent compound, or ligands in which carbon atoms or hydrogen atoms in the chain or cyclic hydrocarbon as a parent compound are partially replaced by other atoms or atomic groups.

(2) The silver halide photographic material according to Embodiment 1, wherein the silver halide emulsion contains the metal complex in silver halide grains.

(3) The silver halide photographic material according to Embodiment 2, wherein the complex is represented by the following formula (I), (II) or (III):

$$[ML_nX_{(C-n)}]^z \quad (I)$$

$$[ML'_mX_{(C-2m2)}]^z \quad (II)$$

$$[ML''_2]^z \quad (III)$$

wherein M represents a metal or a metal ion; L, L' and L" each represent a ligand having as its basic structure a chain or cyclic hydrocarbon whose carbon atoms or hydrogen atoms are partially replaced by other atoms or atomic groups, provided that L represents a monodentate ligand, L' represents a bidentate ligand and L" represents a tridentate ligand, wherein the ligands represented by L, L' and L" may be either the same or different from each other; X represents arbitrary ligands; C is 4 or 6, and when C is 6, n is 4, 5 or 6 and m is 2 or 3, while when C is 4, n is 3 or 4 and m is 2; and z represents an integer of from −6 to +4.

(4) The silver halide photographic material according to Embodiment 3, wherein one or more ligands each containing at least one negative charged moiety formed by a dehydrogenation occupy a majority of the metal coordination site in the complex represented by formula (I), formula (II) or formula (III).

(5) The silver halide photographic material according to Embodiment 3, wherein one or more ligands each containing at least one coordination site except for the site bonding the central metal ion occupy a majority of the metal coordination site in the complex represented by formula (I), formula (II) or formula (III).

(6) The silver halide photographic material according to Embodiment 4, wherein the ligand represented by L in formula (I), L' in formula (II) or L" in formula (III) is comprised of a 5- or 6-membered heterocyclic ring.

(7) The silver halide photographic material according to Embodiment 5, wherein the ligand represented by L in formula (I), L' in formula (II) or L" in formula (III) is comprised of a 5- or 6-membered heterocyclic ring.

(8) The silver halide photographic material according to Embodiment 6, wherein the heterocyclic moiety containing L in formula (I) or L' in formula (II) is selected from pyrrole, pyrazole, imidazole, 1,2,3-triazole, 1,2,4-triazole, tetrazole and 2,2'-biimidazole moieties.

(9) The silver halide photographic material according to Embodiment 7, wherein the heterocyclic moiety containing L in formula (I) or L' in formula (II) is selected from oxazoline, oxazole, isoxazole, thiazoline, thiazole, isothiazole, thiadiazole, furazan, pyridazine, pyrimidine, pyrazine, triazine, oxadiazine, thiadiazine and dithiazine moieties.

(10) The silver halide photographic material according to Embodiment 4, wherein the negative charge moiety formed by a dehydrogenation in the ligand L in formula (I), L' in formula (II) or L" in formula (III) is onto the substituent bonding to the aromatic ring.

(11) The silver halide photographic material according to Embodiment 5, wherein the coordination site in the ligand L in formula (I), L' in formula (II) or L" in formula (III) is onto the substituent bonding to the aromatic ring.

(12) The silver halide photographic material according to Embodiment 10, wherein the substituent in the ligand L in formula (I), L' in formula (II) or L" in formula (III) is selected from the group consisting of an alcohol, carboxylic acid, peroxy acid, sulfonic acid, sulfinic acid, sulfenic acid, nitro group, isocyanide, hydroperoxide, amidocarboxylic acid, azoxy group, azohydroxide, hydroxylamine and oxime.

(13) The silver halide photographic material according to Embodiment 11, wherein the substituent in the ligand L in formula (I), L' in formula (II) and L" in formula (III) is selected from the group consisting of amine, imine, hydrazine, ketone, aldehyde, ether, ester, peroxide, acid anhydride, acid halide, amide, hydrazide, imide, nitrite, cyanic acid ester, thiocyanic acid ester, nitro group, nitroso group, alkyl nitrate, alkyl nitrite, acylamine and nitrile oxide.

(14) The silver halide photographic material according to Embodiment 12, wherein the aromatic moiety bonding the negative charged substituent formed by a dehydrogenation in the ligand L in formula (I), L' in formula (II) or L" in formula (III) is selected from furan, thiophene, pyran, pyridine, benzene, 2,2'-bithiophene, 2,2'-bipyridine and 2,2':6',2"-terpyridine moieties.

(15) The silver halide photographic material according to Embodiment 13, wherein the aromatic moiety bonding the substituent as coordination site in the ligand L in formula (I), L' in formula (II) or L" in formula (III) is selected from furan, thiophene, pyran, pyridine, benzene, 2,2'-bithiophene, 2,2'-bipyridine and 2,2':6',2"-terpyridine moieties.

(16) The silver halide photographic material according to Embodiment 3, wherein the metal ion represented by M is magnesium, cobalt, iron, ruthenium or zinc ion.

(17) The silver halide photographic material according to Embodiment 3, wherein the ligands represented by X in formulae (I) and (II) each is $H_2O$, $NH_3$ or a monovalent anion.

DETAILED DESCRIPTION OF THE INVENTION

As described, e.g., in *Bulgarian Chem. Commun.,* 20 (1993) 350–368, *Radiat. Eff. Defects Solids,* 135(1955) 101–104, and *J. Phys.: Condens Matter,* 9(1977) 3227–3240, the hexacyano-complexes added for doping silver halide grains introduce shallow electron centers arising from the coulombic traps traps into the silver halide grains. In particular, when the complex contains a divalent metal ion, such as $Fe^{2+}$ or $Ru^{2+}$, as its central metal (ion), electron traps having an optimum depth can be introduced by an excess charge of +1 to elongate the time from the generation of photoelectrons by exposure to the deactivation thereof, thereby considerably increase the photographic speed, as disclosed in *ICPS,* 1998, *Final program and Proceedings*, Vol. 1, p.89, *ICPS,* 1998, *Final program and Proceedings*, Vol. 1, p.92, and JP-A-8-286306. Therein the cyanide ions become ligands essential to producing a large ligand-field effect on the complex used as a dopant to raise the lowest unoccupied molecular orbital (LUMO) of the complex to an energy level higher than the lowest energy level of the conduction band of silver halide grains, thereby avoiding strong capture of photoelectrons. On the other hand, the heterocyclic compounds containing a π-conjugated system in the vicinity of a donor atom have an effect of back-donation from the electrons-occupied $t_{2g}$ orbital of a metal ion to an unoccupied $\pi^*$ orbital of ligand. Therefore, those compounds are expected to produce the same effect as cyanide ion produces. So the present inventors have considered the problem of reproducing the same situations as the hexacyano-complexes have as dopants for increasing the photographic speed by the use of metal complexes wherein each of the coordination sites of the metal ion is occupied by one molecule of an aromatic heterocyclic compound and the total number of the coordinated molecules is 6 (or 4). As a result of Density Functional Theory (DFT) calculations (by Gaussian 94), it is ascertained that the highest occupied molecular orbital (HOMO) and the lowest unoccupied molecular orbital LUMO) of a metal complex having an aromatic heterocyclic molecule at every coordination site are both apt to have lower energy than those of the hexacyano-complex containing the same central metal ion, but the splitting width between those two energy levels of the metal complex is almost the same as that of the hexacyano-complex. In other words, as far as these complexes are not in the state of doping silver halide grains, it is thought that the electronic state of a hexacyano-complex can be reproduced by substitution of the organic ligands for all the cyano ligands.

In view of the incorporation of metal complex into silver halide grains, on the other hand, the use of large organic ligands is thought to be at a disadvantage. Therefore, it is thought to be desirable that the number of organic ligands is reduced as greatly as possible. The same DFT calculations are made with respect to the metal complexes containing heterocyclic ligands and halogen anions, such as $Cl^-$ under a condition that the number of heterocyclic ligands is reduced one by one in return for an increase of the number of halogen anions one by one. As a result thereof, both HOMO and LUMO show changes well corresponding to the ligand substitution, and the energy gap decreases with an increase in the number of halogen anions. The energy change by ligand substitution is much greater in HOMO than in LUMO. From these calculations, it is concluded that the electronic state of a hexacyano-complex, which provides shallow electron traps, can be reproduced by a metal complex containing many aromatic heterocyclic ligands. However, the configuration of energy levels concerning the HOMO and LUMO of the complex and the conduction band and valence band of silver halide grains is not yet determinable. Consequently, the least necessary number of organic compound ligands cannot be also determined.

Then, the necessary number of organic ligands is considered from the synthetic point of view. In the case of Ru complexes containing as ligands both 2,2'-bipyridine (bpy) molecules and halogen ions ($Cl^-$), as described in *Inorg. Chim. Acta,* 195 (1992) 221–225, the Ru ion is present in a divalent state when two or three of the ligands are bpy molecules, but the Ru ion is present in a trivalent or tetravalent state when only one of the ligands is bpy molecule. The Ru (III) complexes are known to have undesirable effect upon photographic speed. The change of the valency of the Ru ion from divalent to trivalent reduces the number of d electrons from 6 to 5. When the central metal ion has the electronic structure of $d^5$, an unpaired electron appears in the $t_{2g}$ orbital which is on a lower level than the $e_g$ orbital. And this orbital $t_{2g}$ is able to accept an electron from the outside of the complex molecule. In this electronic state, as described in JP-A-10-293377, the d orbital of the metal ion forms a deep electron trap and thereby the complex fails in contributing to enhancement of photographic speed. More specifically, it can be said that a necessary condition to a dopant enabling an increase in photographic speed consists in filling up the $t_{2g}$ orbital of the central metal ion. In order to meet such a condition, a majority of the coordination sites to the central metal ion are required to be occupied by ligants capable of producing a strong ligand field, such as heterocylic compounds.

When the octahedral complexes coodinated with six ligands are incorporated as dopants into silver halide grains, as described in many references, including *J. Phys.: Condens. Matter,* 9 (1997) 3227–3240, and many invention, the $[AgX_6]^{5-}$ ($X^-$=halogen ion) in silver halide grains functions as a unit to enable partial replacement of the grains by the dopants. Accordingly, when the molecular size of a complex for doping is too large, the complex is supposed to be unsuitable for the dopant. Further, it is thought that the complex to dope silver halide grains becomes more unsuitable for the replacement the more different the complex charge is from −5. According to the consideration based on molecular modeling, in a case where the complex for doping has 5-membered or 6-membered ring as the ligands, it becomes possible to incorporate the complex molecules or ions into the interior of grains by distortion of the grain structure around the complex molecule or ion introduced or by replacement of not only $[AgBr_6]^{5-}$ but also $Ag^+$ adjacent thereto.

In order to incorporate a metal complex into silver halide grains in a condition as close as possible to the NaCl type of crystal structure inside the silver halide grains, it is desirable for the complex used as a dopant to contain ligands having a negative charge. As such ligands, it is desirable to use compounds having inside each molecule a moiety at least capable of having a negative charge. Therefore, the 5-membered or 6-membered heterocyclic compounds having a small molecular size and the possibility of having a negative charge are suitable for ligands. Further, in order to create in the complex for doping a condition as similar as possible to the unit $[AgX_6]^{5-}$ to be replaced, it is advantageous that the ligands each have the electric charge of −1 or be a compound having inside the molecule a moiety capable of having electric charge of −1. Since the energy gap between HOMO and LUMO becomes greatest when all the coordination sites of the central metal are occupied by heterocyclic ligands, the most suitable complexes are complexes containing heterocyclic molecules alone as each individual ligands. Although it is unnecessary for all the ligands in a complex to be the same, it is advantageous for the complex to have the same compound at every coordination site from the viewpoints of synthesis and molecular design. For the aforementioned reasons, the complexes according to the invention are thought to be more favorable than those used in the past, such as $[Fe(EDTA)]^{2-}$ and $[Ir(C_2O_4)]^{3-}$.

The heterocyclic compounds suitable for ligands of the complexes of the present invention are specifically compounds capable of having a negative charge by elimination of $H^+$ therefrom, including pyrrole, pyrazole, imidazole, triazole and tetrazole. And the derivatives of these compounds are also suitable for the ligands. Suitable examples of substituent groups of the foregoing derivatives include a hydrogen atom, a substituted or unsubstituted alkyl group (e.g., methyl, ethyl, n-propyl, isopropyl, n-butyl, t-butyl, hexyl, octyl, 2-ethylhexyl, dodecyl, hexadecyl, t-octyl, isodecyl, isostearyl, dodecyloxypropyl, trifluoromethyl, methanesulfonylaminomethyl), an alkenyl group, an alkynyl group, an aralkyl group, a cycloalkyl group (e.g., cyclohexyl, 4-t-butylcyclohexyl), a substituted or unsubstituted aryl group (e.g., phenyl, p-toylyl, p-anisyl, p-chlorophenyl, 4-t-butylphenyl, 2,4-di-t-aminophenyl), a halogen atom (e.g., fluorine, chlorine, bromine, iodine), a cyano group, a nitro group, a mercapto group, a hydroxyl group, an alkoxy group (e.g., methoxy, butoxy, methoxyethoxy, dodecyloxy, 2-ethylhexyloxy), an aryloxy group (e.g., phenoxy, p-tolyloxy, p-chlorophenoxy, 4-t-butylphenoxy), an alkylthio group, an arylthio group, an acyloxy group, a sulfonyloxy group, a substituted or unsubstituted amino group (e.g., amino, methylamino, dimethylamino, anilino, N-methylanilino), an ammonio group, a carbonamido group, a sulfonamido group, an oxycarbonylamino group, an oxysulfonylamino group, a substituted ureido group (e.g., 3-methylureido, 3-phenylureido, 3,3-dibutylureido), a thioureido group, an acyl group (e.g., formyl, acetyl), an oxycarbonyl group, a substituted or unsubstituted carbamoyl group (e.g., ethylcarbamoyl, dibutylcarbamoyl, dodecyloxypropylcarbamoyl, 3-(2,4-di-t-amylphenoxy)propylcarbamoyl, piperidinocarbonyl, morpholinocarbonyl), a thiocarbonyl group, a thiocarbamoyl group, a sulfonyl group, a sulfinyl group, an oxysulfonyl group, a sulfamoyl group, a sulfino group, a sulfano group, a carboxylic acid group or a salt thereof, a sulfonic acid group or a salt thereof, and a phosphoric acid group or a salt thereof. Further, the compounds containing a saturated carbon, aromatic carbon or heterocyclic aromatic ring formed by being subjected adjacent substituent groups present in the derivatives as described above to ring closure are also favorably used as ligands of the present complexes. In addition, the compounds having a skeleton formed by linking up some rings selected from those described above (specifically pyrrole, pyrazole, imidazole, triazole and tetrazole rings) so as to function as a bidentate or tridentate ligand are also used to advantage. Of such compounds, 2,2'-biimidazole and derivatives thereof are preferred in particular. Furthermore, the compounds containing a moiety having a negative charge in a substituent group but not in a ring as a constituent of their basic structures are also used as suitable ligands. In view of the ligand-field effect, the presence of aromaticity in the neighbor of a coordinated atom is thought to be desirable in these cases also. Suitable examples of such compounds include compounds containing furan, thiophene, pyran, pyridine, 2,2'-bithiophene, 2,2'-bipyridine, or 2,2':6',2"-terpyridine as each individual basic structure and as each individual substituent group an alcohol, carboxylic acid, peroxy acid, sulfonic acid, sulfinic acid, sulfenic acid, nitro, isocyanide, hydroperoxide, amidocarboxylic acid, azoxy, azohydroxide, hydroxylamino or oxime group.

When the silver halide grains are doped with a metal complex having a large size through replacement of not only $[AgBr_6]^{5-}$ but also $Ag^+$ adjacent thereto, the electric charge required for the part corresponding to each ligand is ±0. So it is desirable that each ligand in such a case is chargeless. However, the consideration based on molecular modeling reveals that the 5-membered or 6-membered ligand substituted for $Br^-$—$Ag^+$ is a little too small to completely fill up the space corresponding to $Br^-$—$Ag^+$. Therefore, the stable doping of silver halide grains with such a metal complex requires that the complex has some interaction with the environment.

The view similar to the above is disclosed in JP-A-11-102042, and therein the complexes containing in each individual ligand a group capable of adsorbing to silver halide grains, such as mercapto group, thion group or a group capable of forming imino silver, are used as dopants. In the case of a hexacyano-complex, it is supposed that the grains grow as the complex ions are adsorbed to the grain surface, because the association constant between the hexacyano-complex and silver is very large. On the other hand, in the case of a complex containing organic compounds as a majority of its ligands, it is supposed that the complex ions are encapsulated into troughs formed by the ununiformly growing on the grain surface and the grains grow at a speed higher than the dissociation speed of complex ions; as a result, the grains are doped with complex ions. (Therefore, the grain growth under a highly supersaturated condition is advantageous to the present dopants, but that under a slightly supersaturated condition is disadvantageous.) Such being the case, it is unnecessary for the complex ions to be strongly adsorbed to the surface of silver halide grains. On the contrary, the strong interaction with silver ion is undesirable from the viewpoint of photographic speed. As already mentioned, a photoelectron is trapped weakly by excess charge of +1 on hexacyano-complex center to heighten the photographic speed. By using the complex having chargeless ligands in the invention, it can be expected that the excess charge of +1 can be distributed not only on the central metal ion but also over the ligands, and thereby it becomes possible to gather photoelectrons generated by exposure from a wider area. With respect to the formation of latent image inside the silver halide grains, it can be expected that, as in the impurity band of a semiconductor, freer movement of optically excited electrons in a wide area results in highly efficient formation of latent image. Actually, the ENDOR experiment described in *J. Phys.: Condens Matter,* 9 (1997) 3227–3240, teaches that the concentration range of hexacyanoferrate (II) added as a dopant to an emulsion at which the signal from an unpaired electron supposed to be captured by the impurity band begins to be observed accords with the concentration range at which the photographic speed of the doped emulsion increases clearly. The electronic properties such as a shallowly trapped electron state can be described by effective mass approximation, and can be modeled as a hydrogen atom in a "1s"-like orbital. Therefore, it is anticipated that if the radius of the orbital to which the electron is captured coulombly can be enlarged, the greater increase in photographic speed can be brought about. From this viewpoint also, it is desirable that the chargeless organic compounds are used as ligands. On the other hand, when the complex is adsorbed strongly to silver ions via the adsorbing groups in its ligands, large polarization occurs inside the complex molecule. Such polarization is extremely undesirable from the viewpoint that no localization of an electron in an electron trap is desirable for forming an appropriate shallow electron center by a dopant. Accordingly, in order to effectively function a metal complex dopant as a shallow electron trap, it is desirable that the dopant contain ligands showing the weakest interaction with silver ions upon incorporation into grains.

As described in *Comprehensive Coordination Chemistry*, Vol. 5, 775–851, and *Coord. chem. Rev.,* 35(1981)253, 45(1982)307, 67(1985)297, 115(1992)141, 131(1994)1 and 146 Part 1(1996)211, wide variety of atoms and substituent groups can interact with (complex) $Ag^+$ ions, with examples including alcohol, carboxylic acid, peroxy acid, sulfonic acid, sulfinic acid, isocyanic acid, hydroperoxide, amidocarboxylic acid, amine, imine, hydrazine, ketone, aldehyde, ether, ester, peroxide, acid anhydride, acid halide, amide, imide, nitrite, cyanic acid ester, thiocyanic acid ester, nitro group, nitroso group, alkyl nitrate, alkyl nitrite, acylamine, nitril oxide, hydroxylamine, azo group, azomethine, oxime, phosphine, arsenic and antimony. Of these substituents, amine, imine, hydrazine, ketone, aldehyde, ether, ester, peroxide, acid anhydride, acid halide, amide, hydrazide, imide, nitrite, cyanic acid ester, thiocyanic acid ester, nitro group, nitroso group, alkyl nitrate, alkyl nitrite, acylamine and nitril oxide are preferred from the viewpoint that it is advantageous for the substituent to have no electric charge. Further, since the size of ligands constitutes a hindring factor in incorporating a metal complex into grains, the compounds having a small size, namely 5- or 6-memberred heterocyclic compound, are suitable for the ligands. Although it is advantageous from the viewpoints of synthesis and molecular design that the complex contain the same ligand on every coordination site, it is also desirable to use one or two halogen ions as ligands so that the complex resembles as closely as possible the state of silver halide grains. Further, as far as both the electronic condition of a complex and the interaction between the complex and silver ions are taken into account, the combined use of 2,2'-bipyridine or 2,2':6', 2"-terpyridine with ligands having a moiety capable of interacting with silver ion is also preferred.

As to the ligands capable of interacting with silver ions, the ligands having an interaction site in each individual skeleton are best. Examples of such ligands include oxazoline, oxazole, isoxazole, thiazoline, thiazole, isothiazole, thiadiazole, furazane, pyridazine, pyrimidine, pyrazine, triazine, oxadiazine, thiadiazine and dithiazine. Of these compounds, oxazole, thiazole and pyrazine are preferred in particular. In each of such rings, two atoms which can become coordination sites are located opposite each other. Therefore, such complexes are supposed to have a structure most suitable for interaction with $Ag^+$ when used as dopant. Further, it is also desirable to use the derivatives of those rings as ligands. Examples of substituents which can be present in such derivatives include a hydrogen atom, a substituted or unsubstituted alkyl group (e.g., methyl, ethyl, n-propyl, isopropyl, n-butyl, t-butyl, hexyl, octyl, 2-ethylhexyl, dodecyl, hexadecyl, t-octyl, isodecyl, isostearyl, dodecyloxypropyl, trifluoromethyl, methanesulfonylaminomethyl), an alkenyl group, an alkynyl group, an aralkyl group, a cycloalkyl group (e.g., cyclohexyl, 4-t-butylcyclohexyl), a substituted or unsubstituted aryl group (e.g., phenyl, p-toylyl, p-anisyl, p-chlorophenyl, 4-t-butylphenyl, 2,4-di-t-aminophenyl), a halogen atom (e.g., fluorine, chlorine, bromine, iodine), a cyano group, a nitro group, a mercapto group, a hydroxyl group, an alkoxy group (e.g., methoxy, butoxy, methoxyethoxy, dodecyloxy, 2-ethylhexyloxy), an aryloxy group (e.g., phenoxy, p-tolyloxy, p-chlorophenoxy, 4-t-butylphenoxy), an alkylthio group, an arylthio group, an acyloxy group, a sulfonyloxy group, a substituted or unsubstituted amino group (e.g., amino, methylamino, dimethylamino, anilino, N-methylanilino), an ammonio group, a carbonamido group, a sulfonamido group, an oxycarbonylamino group, an oxysulfonylamino group, a substituted ureido group (e.g., 3-methylureido, 3-phenylureido, 3,3-dibutylureido), a thioureido group, an acyl group (e.g., formyl, acetyl), an oxycarbonyl group, a substituted or unsubstituted carbamoyl group (e.g., ethylcarbamoyl, dibutylcarbamoyl, dodecyloxypropylcarbamoyl, 3-(2,4-di-t-amylphenoxy)propylcarbamoyl, piperidinocarbonyl, morpholinocarbonyl), a thiocarbonyl group, a thiocarbamoyl group, a sulfonyl group, a sulfinyl group, an oxysulfonyl group, a sulfamoyl group, a sulfino group, a sulfano group, a carboxylic acid group or a salt thereof, a sulfonic acid group or a salt thereof, and a phosphoric acid group or a salt thereof. Further, when any two among those substituents are subjected to ring closure at adjacent positions, they may be combined with each other to form a saturated carbon ring, an aromatic carbon ring or heterocyclic aromatic ring.

As the ligands interacting with silver ions, the compounds having interaction sites in their substituent groups alone and no interaction sites in their individual skeletons are also favorably used. Suitable examples of a basic skeleton include a furan ring, a thiophene ring, a pyridine ring and a benzene ring, and examples of a substituent preferred as the interaction site include amine, imine, hydrazine, ketone, aldehyde, ether, ester, peroxide, acid anhydride, acid halide, amide, hydrazide, imide, nitrite, cyanic acid ester, thiocyanic acid ester, nitro group, nitroso group, alkyl nitrate, alkyl nitrite, acylamine and nitril oxide.

As the ligands according to the invention, the ligands having no negative charge but capable of interacting with the environment as well as those having negative charge are mentioned above. The ligands of these two types are seemingly counter to each other, but both have their individual advantages, judging from not only theoretical study but also experimental results. Therefore, which type is superior cannot be decided yet.

The metal complexes of the present invention have no particular restrictions as to the central metal (i.e., the central metal ion) usable therein. However, the metals capable of assuming either four-coordinated or six-coordinated structure around them are preferably used. In addition, it is desirable that those metals or the ions thereof have no unpaired electron or, when the d-orbitals of those metals are split by the ligand field, all the stabilized orbitals thereof are filled with electrons. Specifically, among these, the metal ion having a valence of +2 is preferred, further alkaline earth metal, iron(II), ruthenium(II), osmium(II), lead, cadmium and mercury ions are more preferably used to advantage. In particular, magnesium, iron(II), ruthenium(II) and lead ions are preferred.

Examples of a metal complex containing ligands bearing negative charge, which is one of the two types of metal complexes according to the invention, are illustrated below, but these examples should not be construed as limiting the scope of the invention in any way.

$[ML_nX_{(6-n)}]^z$
M = $Mg^{2+}$, $Mn^{2+}$, $Fe^{2+}$, $Ru^{2+}$, $CO^{2+}$, $Ni^{2+}$, $Cu^{2+}$, $Zn^{2+}$, $Cd^{2+}$
X = $Cl^-$, $Br^-$, $F^-$, $I^-$, $OH^-$, $H_2O$, $NH_3$, $CH_3COO^-$, $PO_4^{3-}$, $SO_4^{2-}$, $CO_3^{2-}$, $NO_2^-$, $SO_3^{2-}$, $N_3^-$, $N_2$, $SCN^-$, $CN^-$
$n$ = 4, 5, 6
z = -6→+2
L =
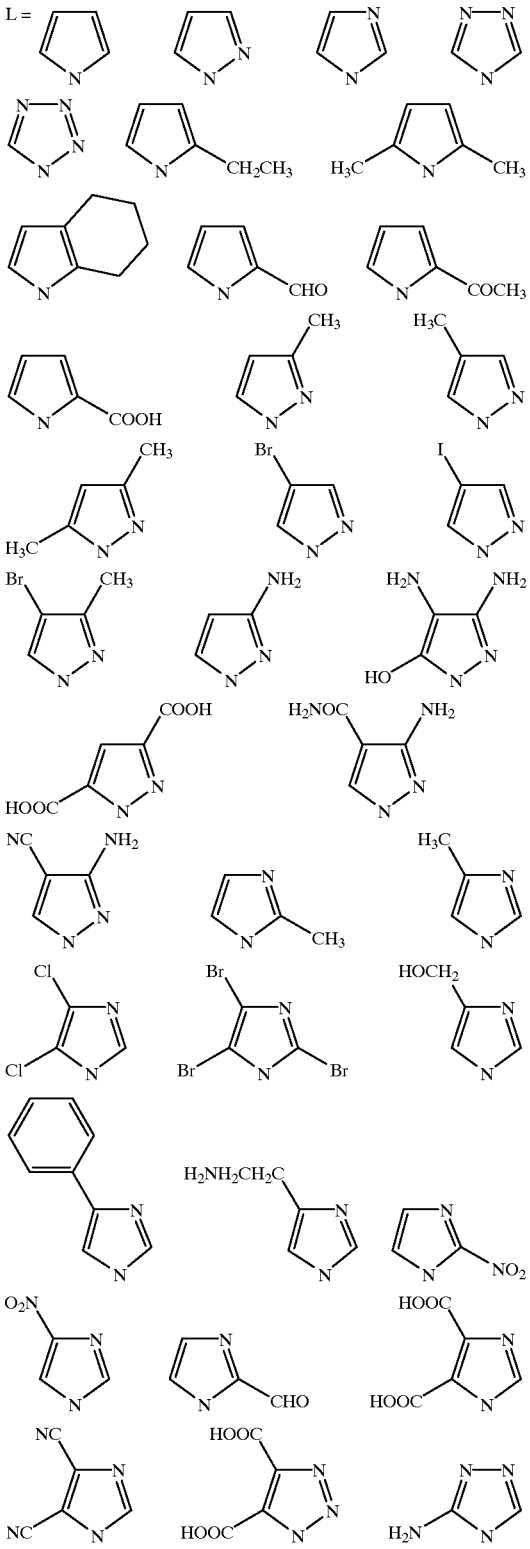
-continued
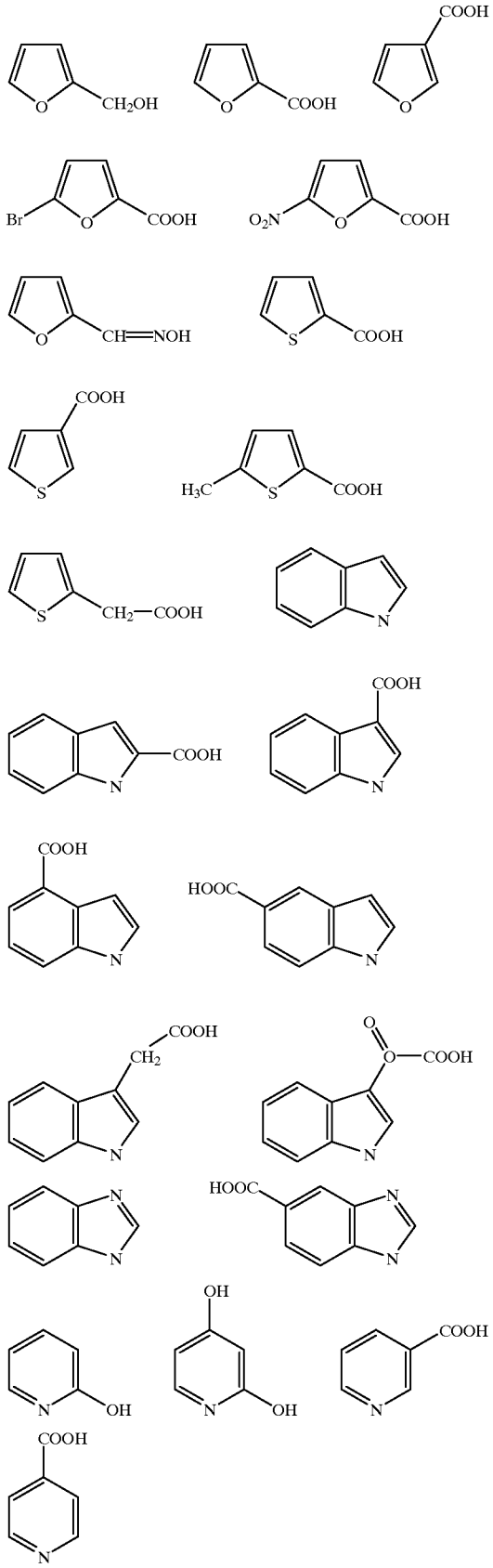

-continued
$[ML'_mX_{(6-2m)}]^z$
M = $Mg^{2+}$, $Mn^{2+}$, $Fe^{2+}$, $Ru^{2+}$, $CO^{2+}$, $Ni^{2+}$, $Cu^{2+}$, $Zn^{2+}$, $Cd^{2+}$
X = $Cl^-$, $Br^-$, $F^-$, $I^-$, $OH^-$, $H_2O$, $NH_3$, $CH_3COO^-$, $PO_4^{3-}$, $SO_4^{2-}$, $CO_3^{2-}$, $NO_2^-$, $SO_3^{2-}$, $N_3^-$, $N_2$, $SCN^-$, $CN^-$
*m* = 2, 3
z = -6→+2
L =
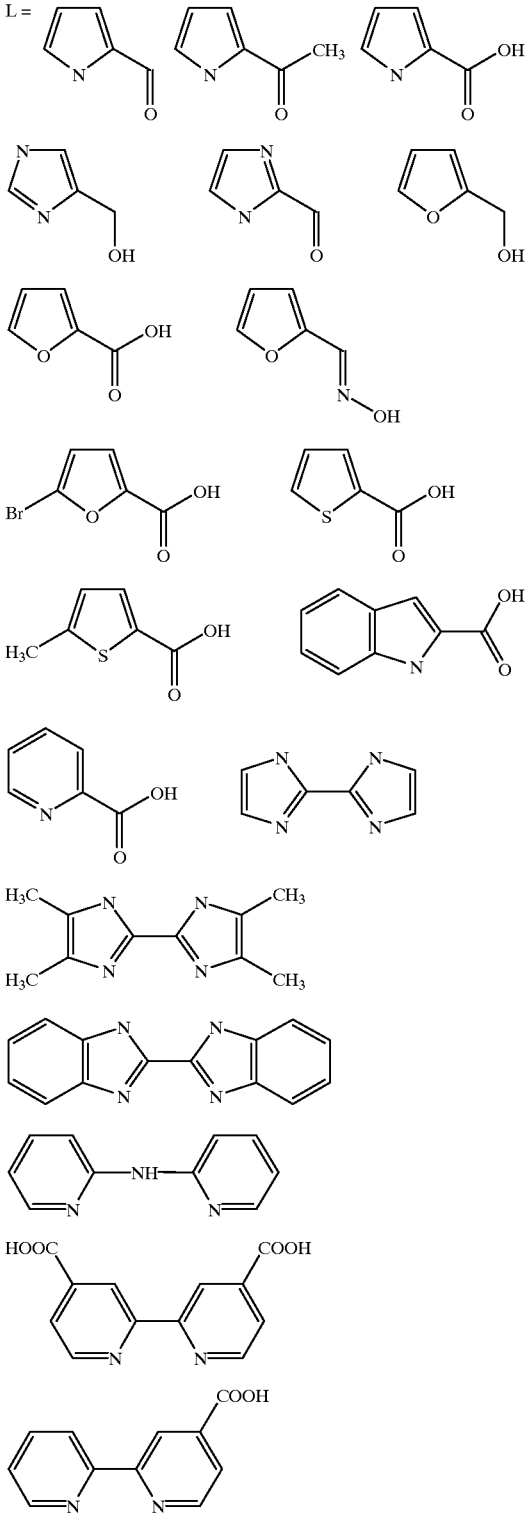
-continued
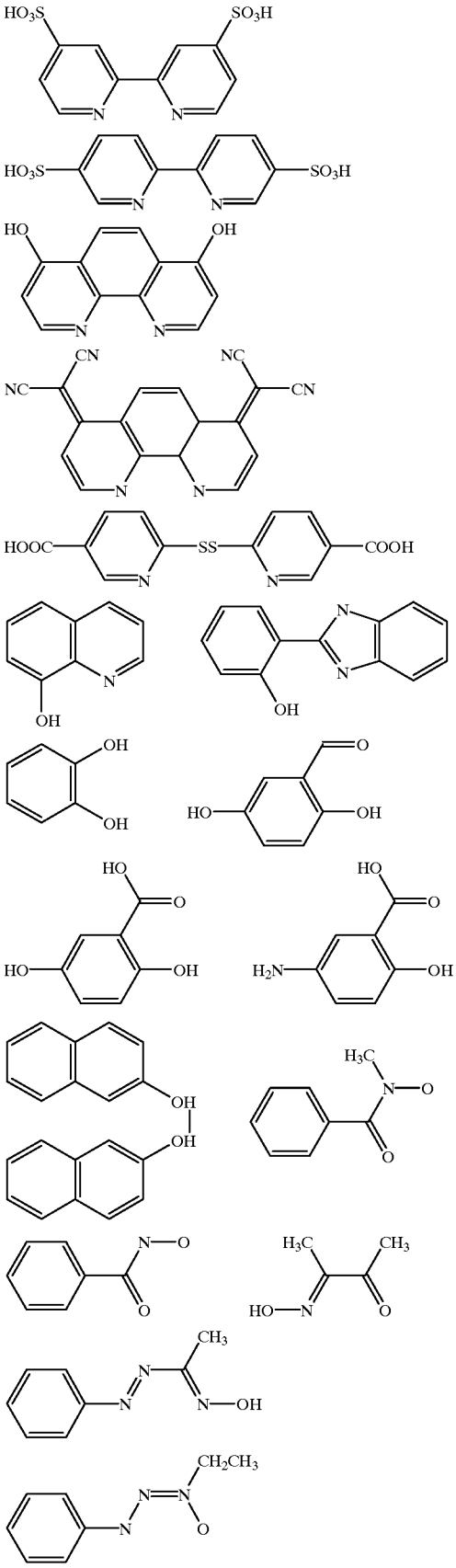

-continued $[ML''_2]^z$

M = $Mg^{2+}$, $Mn^{2+}$, $Fe^{2+}$, $Ru^{2+}$, $CO^{2+}$, $Ni^{2+}$, $Cu^{2+}$, $Zn^{2+}$, $Cd^{2+}$ z = -6→+2

L =

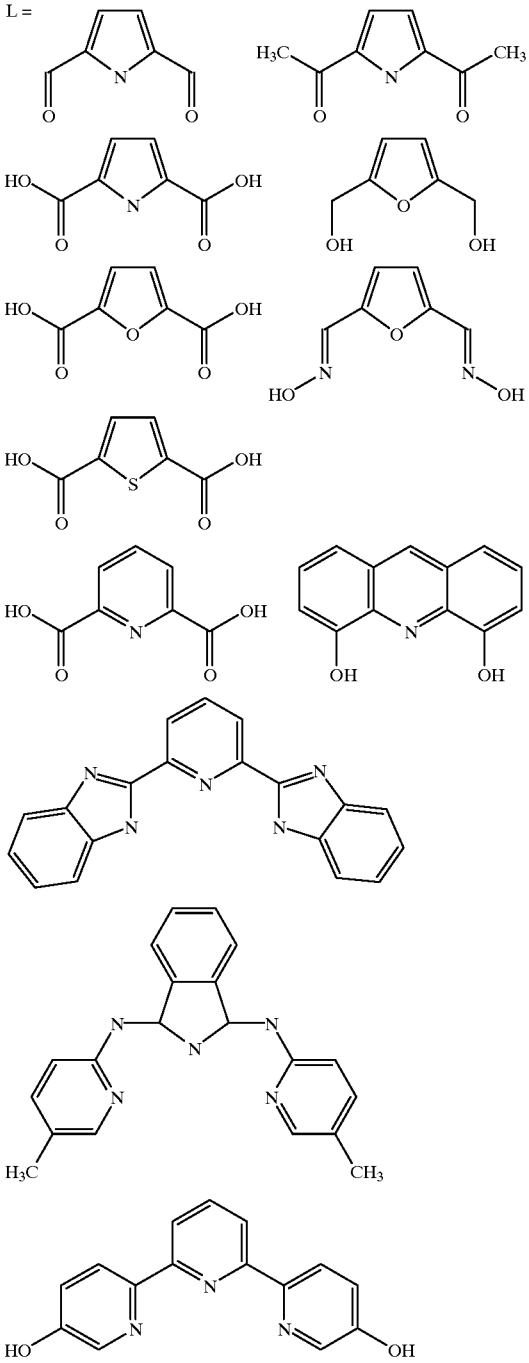

In the metal complexes as recited above, each ligand may be in either $H^+$-added or $H^+$-eliminated state.

Secondly, examples of a metal complex containing ligands capable of coordinating with at least two metal ions at the same time (namely, the aforementioned ligands having no electric charge but capable of interacting with the environment (including $Ag^+$ ions)) are illustrated below.

$(ML_nX_{(6-n)})^z$

M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$

X = $Cl^-$, $Br^-$, $F^-$, $I^-$, $OH^-$, $H_2O$, $NH_3$, $CH_3COO^-$, $PO_4^{3-}$, $SO_4^{2-}$, $CO_3^{2-}$, $NO_2^-$, $SO_3^{2-}$, $N_3^-$, $N_2$, $SCN^-$, $CN^-$ $n$ = 4, 5, 6

$z$ = -6→+2

L =

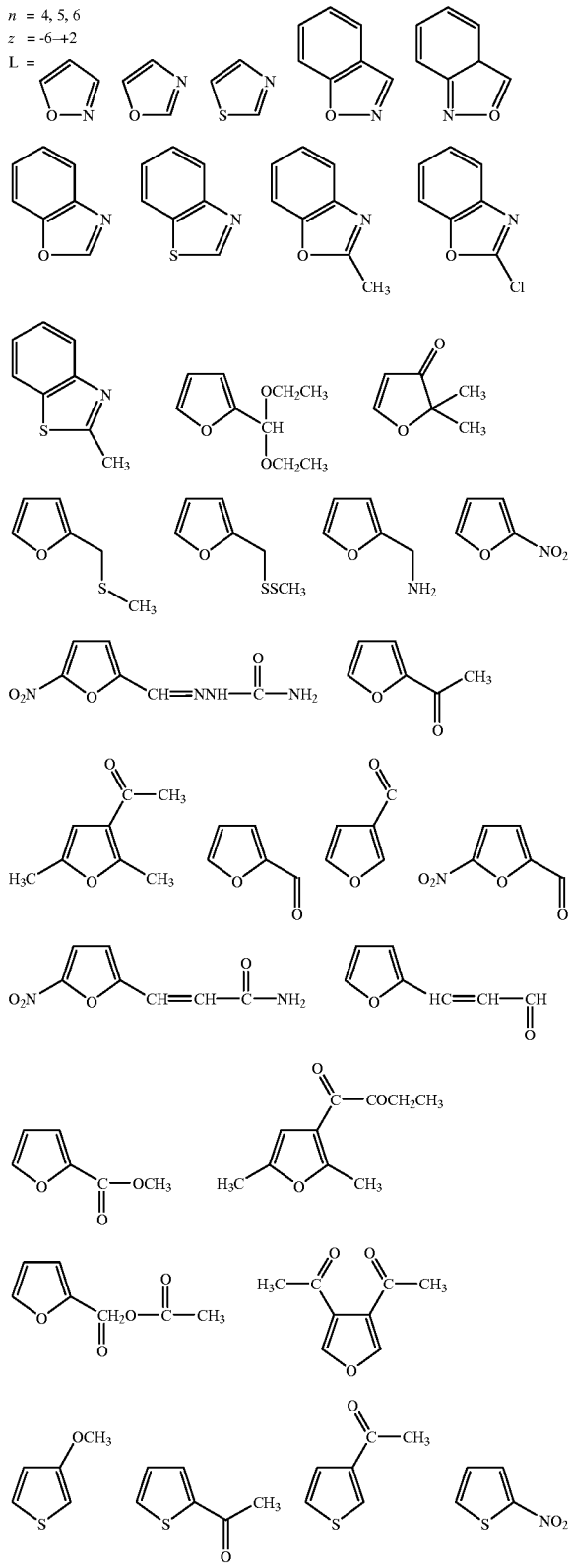

-continued
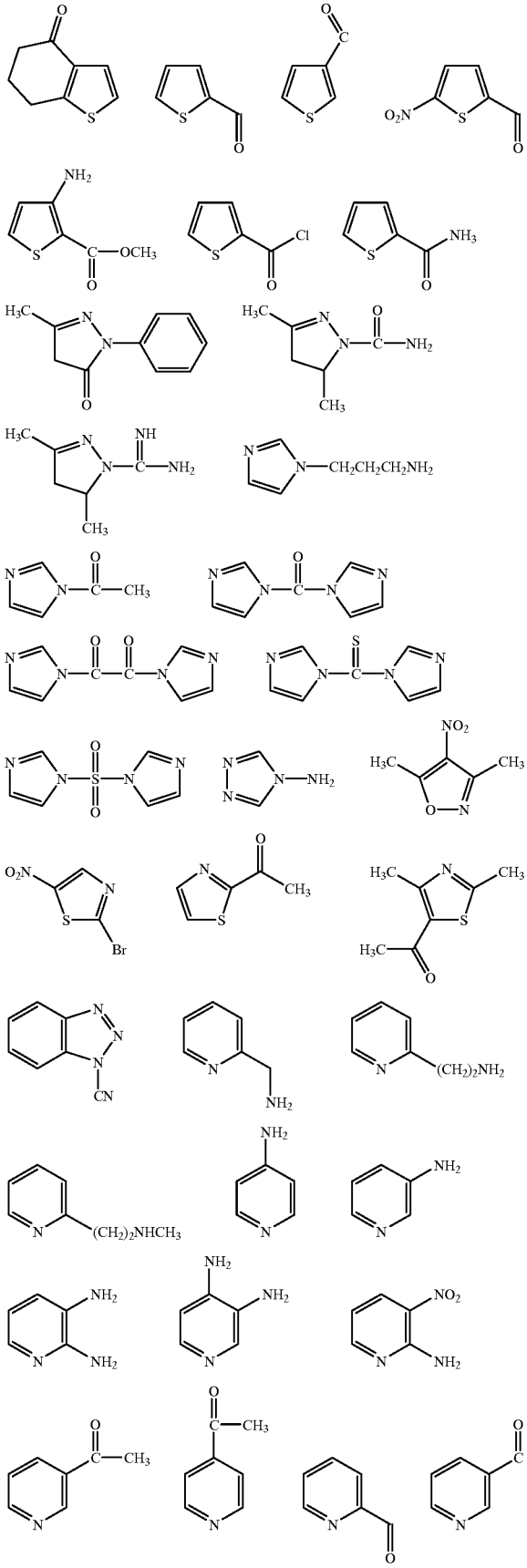
-continued
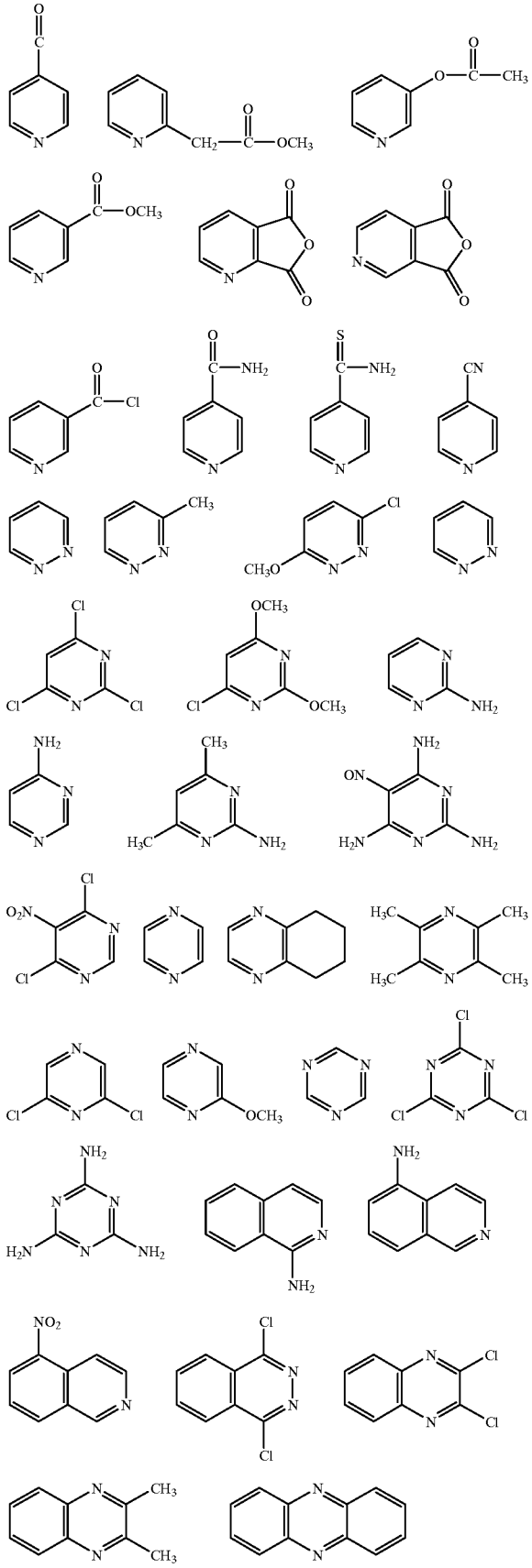

-continued
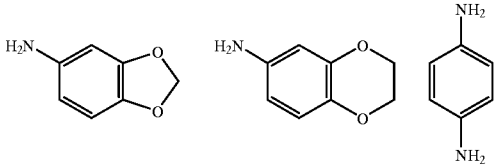
$(ML_{-m}'X_{(6-2m)})^z$
M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$
X = $Cl^-$, $Br^-$, $F^-$, $I^-$, $OH^-$, $H_2O$, $NH_3$, $CH_3COO^-$, $PO_4^{3-}$, $SO_4^{2-}$, $CO_3^{2-}$, $NO_2^-$, $SO_3^{2-}$, $N_3^-$, $N_2$, $SCN^-$, $CN^-$
$n$ = 2, 3
$z$ = -6–+2
L =
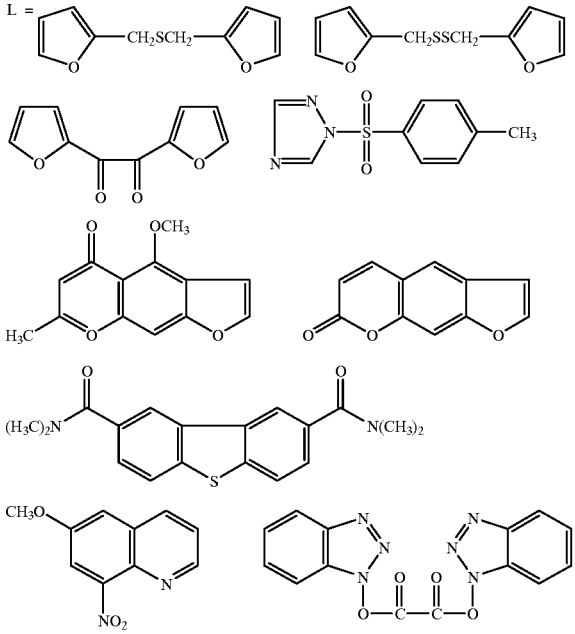
-continued
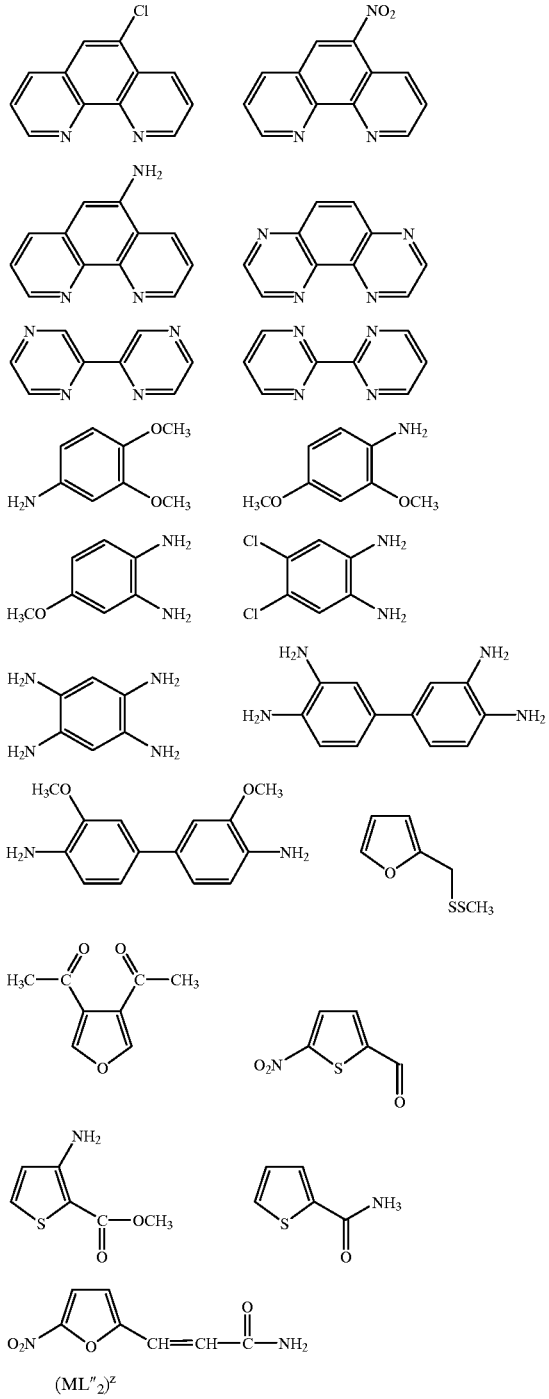
$(ML''_2)^z$
M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$
$z$ = -6–+2
L =
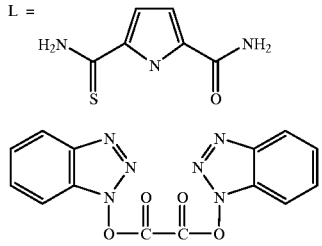

-continued

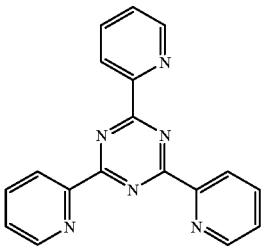

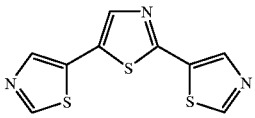

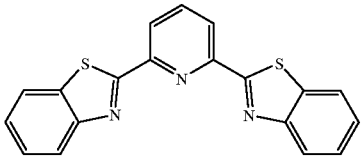

The complexes according to the present invention are completely dissociated in a water solution, and they are present in the form of anion or cation. So the counter ion is not important on the photographic characteristics. However, in view of suitability for precipitation process of silver halide emulsions, the counter cations suitable for the complexes which can become anions by dissociation to form salts together with cations are cations highly soluble in water, including alkali metal ions, such as sodium, potassium, rubidium and cesium ions, ammonium ion and quaternary alkylammonium ions. Suitable examples of alkyl moieties in a quaternary alkylammonium ion include methyl, ethyl, propyl, iso-propyl and n-butyl groups. In particular, quaternary alkylammonium ions whose four alkyl groups are the same, such as tetramethylammonium ion, tetraethylammonium ion, tetrapropylammonium ion and tetra(n-butyl)ammonium ion, are preferable. In addition, in cases where the ligands as described above can form cation by the addition of $H^+$ thereto, the resulting ligands can be favorably used as counter cation.

On the other hand, it is desirable that the counter anions for the complexes which can become cations by dissociation to form salts together with anions be anions which are highly soluble in water to have suitability for precipitation process of silver halide emulsions, such as halogen ion, nitric acid ion, perchloric acid ion, tetrafluoroboric acid ion, hexafluorophosphoric acid ion, tetraphenylboric acid ion, hexafluorosilicic acid ion and trifluoromethanesulfonic acid ion. Additionally, the counter anions having strong tendency for coordination, such as cyano ion, thiocyano ion, nitrous acid ion and oxalic acid ion, are unsuitable because there is a high possibility that the compositions and the structures of the complexes cannot be maintained due to ligand exchange reaction between those anions and the halogen ions used as ligands in the complexes.

The complexes of the present invention can be prepared by a number of methods. For instance, the magnesium, iron or zinc complex containing pyrazole or imizazole as its ligands can be prepared by reacting pyrazole or imidazole with the perchlorate or tetrafluoroborate of each metal in a dehydrated solvent. To be more concrete, the methods of preparation for the imidazole or pyrazole complexes of those metals are described in *Rec. Trav. Chim.* , 1969, 88, 1451. Further, $[Ru(trz)_6]^{4-}$ (trz=1,2,4-triazole) can be prepared by reference to the reaction of $[Ru(bpy)_2(trz)_2]^0$ described in *Inorg. chim. Acta,* 1983, 71, 155. $[Ru(Hdpa)_3]^{2+}$ is a well-known compound, and can be prepared by various methods as described in *Inorg. chim. Acta,* 1992, 195, 221, *Transition Met. Chem.,* 1993, 18, 197, and *J. Phys. Chem.,* 1982, 86, 3768. The many other complexes, especially Ru complexes, can be prepared by using the methods described in *Coord. chem. Rev.,* 84(1988) 85–277 and the references cited therein. In addition, for the synthesis of $[Ru(pyz)_6]^{2+}$ (pyz=pyrazine) *J. Chem. Soc., Chem. Commun.,* (1981) 1216–1217 can be referred to, for the synthesis of $[Fe(thia)_6]^{2+}$ (thia=thiazole) *Polyhedron,* 16(1997) 4279–4283 can be referred to, and for the syntheses of complexes containing pyridine derivatives as ligangs, specifically $[Ru(py)_6]^{2+}$ (py=pyridine) and $[[Fe(py)_6]^{2+}$, *J. Am. Chem. Soc.,* 101 (1979) 4906–4917 and *J. Chem. Soc., Dalton Trans.*, (1988) 1309–1314 can be referred to respectively. Further, the syntheses of Ru complexes having three bidentate ligands are described in *Transition Met. Chem.,* 18(1993) 197–294, *Inorg. Chem.,* 31(1992) 2935–2938 and *J. Am. chem. Soc.,* 98(1976) 6536–6544, the syntheses of Ru complexes having mixed ligands including 2,2'-bipyridine are described in *Inorg. Chim. Acta,* 1982, 61, 299–233and Inorg. Chem., 23(1984) 3002–3010, and the syntheses of 2,2'-bi-2-thiazoline-Ru complexes are described in *J. Am. chem. Soc.,* 101(1979) 4394–4396. The present complexes can be properly synthesized according to the references cited above.

It is desirable that each of the complexes be incorporated into silver halide grains by direct addition to a reaction solution at the step of forming silver halide grains, or by addition to a solution for grain-forming reaction via the addition to an aqueous halide solution or another solution for forming silver halide grains. Also, the combination of these methods may be adopted for doping silver halide grains.

In doping silver halide grains with the present complexes, the complexes may be distributed uniformly inside the grains, or localized so as to have a higher concentration in the grain surface layer as disclosed in JP-A-4-208936, JP-A-2-125245 and JP-A-3-188437. In another way as disclosed in U.S. Pat. Nos. 5,252,451and5,256,530, the grain surface phase may be modified by physically ripening doped fine grains. In still another way, fine grains doped with a complex are prepared, they are added to an emulsion and the resulting emulsion is subjected to physical ripening, thereby doping the silver halide grains with the complex. The aforementioned ways may be adopted in combination.

The suitable amount of each of the complex used as dopant of the present invention is from $1\times10^{-8}$ to $1\times10^{-2}$ mole, preferably from $1\times10^{-6}$ to $1\times10^{-}$mole, per mole of silver halide.

The silver halide emulsions used in the present silver halide photographic materials have no particular restriction as to the silver halide, but any of silver chloride, silver chlorobromide, silver bromide, silver iodochloride and silver iodobromide can be used therein. The silver halide grains have no particular limitation on size, but it is desirable for their size to be from 0.01 to 3 $\mu$m in terms of equivalent sphere diamiter.

The silver halide grains may have a regular crystal form, an irregular crystal form, or any kind of crystal form wherein at least one twin plane is present. Examples of a regular crystal form include the crystal forms of a cube, an octahedron, a dodecahedron, a tetradecahedron, an eicosahedron and an octatetracontahedron, while those of an irregular crystal form include a spherical crystal form and a pebble-like crystal form. Examples of a crystal form having at least one twin plane include those of a tabular hexagon and a tabular triangle which each have two or three parallel twin planes. It is desirable for the grains having such tabular forms to be monodisperse with respect to the grain size distribution. The preparation of monodisperse tabular grains is disclosed in JP-A-63-11928. The description of monodisperse tabular hexagonal grains is found in JP-A-63-151618. The monodisperse tabular circular grain emulsion is described in JP-A-1-131541. Further, -JP-A-2-838 discloses the emulsion wherein at least 95%, based on projected area, of the total grains are tabular grains having two twin planes parallel to the principal plane and the size distribution of these tabular grains is monodisperse. EP-A-0514742 discloses the tabular grain emulsion prepared in the presence of a polyalkylene oxide block polymer and thereby achieving a variation coefficient of 10% or below with respect to the grain size distribution.

There are known the tabular grains whose major surfaces are (100) planes and the tabular grains whose major surfaces are (111) planes, both of which the technique of the present invention can be applied to. The silver bromide of the former type are disclosed in U.S. Pat. No. 4,063,951 and JP-A-5-281640, while the silver chloride of the former type are disclosed in EP-A-0534395 and U.S. Pat. No. 5,264,337. The tabular grains of the latter type can have various shapes wherein at least one twin plane is present, and those of silver chloride are described in U.S. Pat. Nos. 4,399,215, 4,983,508 and 5,183,732, JP-A-3-137632 and JP-A-3-116113.

The silver halide grains may have dislocation lines on the inside. The technique of introducing dislocations into silver halide grains under careful control is disclosed in JP-A-63-220238. According to this gazette, the dislocation can be introduced by forming a particular phase having a high iodide content inside the tabular silver halide grains having an average grain diameter/grain thickness ratio of at least 2 and covering the outside with a phase lower in iodide content than the aforesaid phase having a high iodide content. The introduction of such a dislocation can produce various effects, including an increase in photographic speed, improvement in keeping quality, a rise in latent image stability and reduction in pressure mark. According to the invention of the reference cited above, the dislocations are introduced mainly in the edge part of tabular grains On the other hand, the tabular grains having dislocations introduced in the core part are disclosed in U.S. Pat. No. 5,238,796. Further, the grains having a regular crystal form and dislocations on the inside are disclosed in JP-A-4-348337. And this gazette discloses that the dislocations can be introduced by forming epitaxies of silver chloride or silver chlorobromide on the grains having a regular crystal form and subjecting the epitaxies to physical ripening and/or halogen conversion. Into the silver halide grains according to the invention, dislocations can be introduced by the method of constituting a phase having a high iodide content as well as the method of forming epitaxies of silver chlorobromide on the grains. By the introduction of dislocations in such a way, the effects of increasing the photographic speed and decreasing the pressure mark are produced. The present invention can achieve its effects when at least 50% of the total silver halide grains are grains in which at least 10 dislocation lines per grain are present.

The preparation of silver halide emulsions has no particular restrictions on additives used from the grain formation step till the coating step. For the purpose of promoting the crystal growth in the crystal-forming step or achieving effective chemical sensitization at the time of grain formation and/or chemical sensitization, silver halide solvents can be utilized. As silver halide solvents, it is possible to use water-soluble thiocyanates, ammonia, thioethers and thioureas. More specifically, the thiocyanates disclosed in U.S. Pat. Nos. 2,222,264, 2,448,534 and 3,320,069, ammonia, the thioether compounds disclosed in U.S. Pat. Nos. 3,271,157, 3,574,628, 3,704,130, 4,297,439 and 4,276,347, the thion compounds disclosed in JP-A-53-144319, JP-A-53-82408 and JP-A-55-77737, the amine compounds disclosed in JP-A-54-100717, the thiourea derivatives disclosed in JP-A-55-2982, the imidazoles disclosed in JP-A-54-100717 and the substituted mercaptotetrazoles disclosed in JP-A-57-202531 can be recited as usable silver halide solvents.

The sivler halide emulsions used in the invention has no particular restrictions on their preparation methods. In general, aqueous silver salt and halide solutions are added to a reaction solution containing an aqueous gelatin solution with efficient agitation. The methods usable therein are described in, e.g., P. Glafkides, *Chimie et Physique Photographique*, Paul Montel (196.7), G. F. Dufin, *Photographic Emulsion chemistry*, The Focal Press (1966), V. L. Zelikman, et al., *Making and Coating Photographic Emulsion*, The Focal Press (1964). More specifically, the emulsions may be prepared by any of acid, neutral and ammoniacal methods, and the methods employed for reacting a water-soluble silver salt with a water-soluble halide may be any of a single jet method, a double jet method and a combination thereof. Further, the so-called controlled double jet method, wherein the pAg of the liquid phase in which silver halide grains to be precipitated is maintained constant, may be employed. In addition, it is also desirable that the emulsion grains be made to grow at the highest speed under the critical supersaturation limit by the use of the method of altering the addition speeds of aqueous silver nitrate and alkali halide solutions in proportion to the grain growth speed (as disclosed in U.K. Patent 1,535,016, JP-B-48-36890 and JP-B-52-16364) or the method of changing the concentrations of aqueous solutions (as disclosed in U.S. Pat. No. 4,242,445 and JP-A-55-158124). These methods can be employed to advantage, because they cause no renucleation and ensure uniform growth of silver halide grains.

In another method which can be used to advantage, previously prepared fine grains are added to a reaction vessel instead of adding a silver salt solution and a halide solution to a reaction vessel, thereby causing nucleation and/or grain growth to prepare silver halide grains. The techniques concerning this method are disclosed in JP-A-1-183644, JP-A-1-183645, JP-A-2-44335, JP-A-2-43534, JP-A-2-43535 and U.S. Pat. No. 4,879,208. According to this method, the halogen ion distribution inside the emulsion grains can be uniform throughout to provide desirable photographic characteristics.

On the other hand, emulsion grains having various structures can be used in the invention, too. For instance, the grains constituted of the inner part (core part) and the outside thereof (shell part), or the grains having the so-called core/shell double-layered structure, the grains having a triple-layered structure (disclosed in JP-A-60-222844) and the grains having a multi-layer structure can be used. In a case where the emulsion grains are formed so as to have an internal structure, the internal structure may be not only the wrapped-in structure as described above but also the so-called joined structure as disclosed in JP-A-58-108526, JP-A-59-16254, JP-A-59-133540, JP-B-58-24772 and EP-A2-0199290. Specifically, each host crystal joins crystallites differing therefrom in composition at its edge(s), corner(s) or face(s), and the crystallites are made to grow on the joined site(s) to form a crystal having a joined structure. In forming such crystals joined, the host crystal may have a uniform halide composition or a core/shell structure. In the case of forming a joined structure, though crystals of silver halide can be joined together as a matter of course, another silver salt compound having a structure other than the rock salt structure, such as silver thiocyanate or silver carbonate, may also be used so long as it can attain an epitaxic growth on silver halide crystals.

In the case of silver iodobromide grains having those structures, e.g., a core/shell structure, the iodide content may be high in the core part and low in the shell part, or vice versa. As the silver iodobromide grains having a joined structure, the iodide content may be high in the host crystal and relatively low in the crystal joined to the host crystal, or vice versa. When the grains have an internal structure as mentioned above, the boundary between the parts differing in halide composition may have a clear interface, or may be rendered obscure by forming mixed crystals depending on the difference in halide composition. Also, a continuous change in structure may occur in the boundary region. Further, the silver halide emulsions used in the invention may undergo the treatment for rounding the emulsion grains (as disclosed in EP-B1-0096727 or EP-B1-0064412) or modifying the grain surface (as disclosed in German Patent 2306447 C2 or JP-A-60-221320). Although the invention prefers surface latent image-type silver halide emulsions, it is also possible to use an internal latent image type silver halide emulsion, provided that the developer or developing condition is chosen properly, as disclosed in JP-A-59-133542. In addition, a shallow internal latent image-type emulsion which is covered with a thin shell can be employed depending on the intended use.

In general the silver halide emulsions are spectrally sensitized. Spectral sensitizing dyes usually employed therefor are methine dyes, including cyanine dyes, merocyanine dyes, composite cyanine dyes, composite merocyanine dyes, holopolar cyanine dyes, hemicyanine dyes, styryl dyes and hemioxonol dyes. Any rings usually present in cyanine dyes can be the basic heterocyclic rings of these dyes. Suitable examples of a basic heterocyclic ring include pyrroline, oxazoline, thiazoline, pyrrole, oxazole, thiazole, selenazole, imidazole, tetrazole and pyridine rings. In addition, rings formed by condensing together a hetero ring as described above and an alicyclic hydrocarbon ring, and rings formed by condensing together a hetero ring as described above and an aromatic hydrocarbon ring can also be utilized. Examples of such a condensed ring include indolenine, benzindolenine, indole, benzoxazole, naphthoxazole, benzothiazole, naphthothiazole, benzoselenazole, benzimidazole and quinoline rings. Each of these rings may have a substituent group on any of carbon atoms as the constituent atoms thereof. The merocyanine and composite merocyanine dyes can contain 5- or 6-membered heterocyclic rings, such as pyrazoline-5-one, thiohydantoin, 2-thioxazolidine-2,4-dione, thiazolidine-2,4-dione, rhodanine and thiobarbituric acid rings, as ketomethylene structure-containing rings.

The suitable amount of sensitizing dyes added is from 0.001 to 100 millimole, preferably from 0.01 to 10 millimole, per mole of silver halide. It is desirable for the sensitizing dyes to be added during chemical sensitization or before chemical sensitization (e.g., at the time of grain formation or physical ripening).

In the present invention, the sensitivity to light of the wavelengths at which the chemically sensitized silver halide grains show their intrinsic absorption (namely the intrinsic sensitivity) is improved. More specifically, a decrease in the sensitivity to light of wavelengths longer than about 450 nm which is attributable to the adsorption of spectral sensitizing dyes to the surface of silver halide grains, namely the intrinsic desensitization due to sensitizing dyes, can be lessened by the doping with any of the complexes of the present invention. In other words, besides the effect of increasing the intrinsic sensitivity of silver halide, the present invention has a beneficial effect upon the prevention of the intrinsic desensitization due to sensitizing dyes.

To silver halide emulsions may be added dyes which, although they themselves do not spectrally sensitize silver halide emulsions, or materials which, although they do not absorbh light in the visible region, can exhibit supersensitizing effect in combination with a certain sensitizing dye. Examples of such dyes or materials include aminostilbene compounds substituted b y nitrogen-containing heterocyclic groups (disclosed in U.S. Pat. Nos. 2,933,390 and 3,635,721), aromatic organic acid-formaldehyde condensates (disclosed in U.S. Pat. No. 3,743,510), cadmium salts and azaindene compounds. The combinations of spectral sensitizing dyes with the dyes or materials as described above are disclosed U.S. Pat. Nos. 3,615,613, 3,615,641, 3,617,295and 3,635,721.

In general, the silver halide emulsions are used after undergoing chemical sensitization. For chemical sensistization, chalcogen sensitization (including sulfur sensitization, selenium sensitization, and tellurium sensitization), noble metal sensitization (including gold sensitization) and reduction sensitization can be employed individually or as a combination of at least two thereof. In sulfur sensitization, labile sulfur compounds are used as sensitizer. Examples of such labile sulfur compounds are described in P. Glafkides, *Chimie et Physique Photographique*, 5th ed. , Paul Montel (1087), *Research Disclosure* vol. 307, No. 307105, T. H. James, *The Theory of The Photographic Process,* 4th ed., Macmillan (1977), and H. Frieser, *Die Gründlagender Photographischen Prozess mit Silver-Halogeniden*, Akademische Verlagsgeselbshaft (1968). Examples of suitable sulfur sensitizers which can be used include thiosulfates (such as sodium thiosulfate and p-toluenethiosulfonate), thioureas (such as diphenylthiurea, triethylthiourea, N-ethyl-N'-(4-methyl-2-thiazolyl)thiourea and carboxymethyltrimethylthiourea), thioamides (such as thioacetamide and N-phenylthioacetamide), rhodanines (such as rhodanine, N-ethylrhodanine, 5-benzylidenerhodanine, 5-benzylidene-N-ethylrhodanine and diethylrhodanine), phosphine sulfides (such as trimethylphosphine sulfide), thiohydantoins, 4-oxo-oxazolidine-2-thiones, dipolysulfides (such as dimorphiline disulfide, cystine and hexathiocane-thione), mercapto compounds (such as cysteine), polythionates and elemental sulfur. Also, active gelatins can be utilized as sulfur sensitizer.

In selenium sensitization, labile selenium compounds are used as sensitizer. The labile selenium compounds for such a purpose are disclosed in JP-B-43-13489, JP-B-44-15748, JP-A-4-25832, JP-A-4-109240, JP-A-4-271341 and JP-Ya-5-40324. Examples of suitable selenium sensitizer which can be used include colloidal metallic selenium, selenoureas (such as N,N-dimethylselenourea, trifluoromethylcarbonyl-trimethylselenourea and acetyl-trimethylselenourea), selenoamides (such as selenoacetamide and N,N-dimethylphenylselenamide), phosphine selenides (such as triphenylphosphine selenide and pentafluorophenyl-triphenylphosphine selenide), selenophosphates (such as tri-p-tolylselenophosphate and tri-n-butylselenophosphate), selenoketones (such as selenobenzophenone), isoselenocyanates, selenocarboxylic acids, selenoesters and diacylselenides. In addition, moderately stable selenium compounds (as disclosed in JP-B-46-4553 and JP-B-52-34492), including selenious acid, potassium selenocyanate, selenazoles and selenides, can also be utilized as selenium sensitizers.

In tellurium sensitization, labile tellurium compounds are used as sensitizer. The labile tellurium compounds for such a purpose are disclosed in Canadian Patent 800,958, U.K. Patents 1,295,462 and 1,396,696, JP-A-4-204640, JP-A-4-271341, JP-A-4-333043 and JP-A-5-303157. Examples of suitable tellurium sensitizers which can be used include telluroureas (such as tetramethyl-tellurourea, N,N'-dimethylethylenetellurourea and N,N'-diphenylethylenetellurourea), phosphine tellurides (such as butyldiisopropylphosphine telluride, tirbutylphosphine telluride, tributoxyphosphine telluride and ethoxydiphenylphosphine telluride), diacyl (di)tellurides (such as bis (diphenylcarbamoyl) ditelluride, bis(N-phenyl-N-methylcarbamoyl) ditelluride and bis(ethoxycarbonyl) telluride), isotellurocyanates (such as allylisotellurocyanate), telluroketones (such as telluroacetone and telluroacetophenone), telluroamides (such as telluroacetamide and N,N-dimethyltellurobenzamide), tellurohydrazides (such as N,N'.N'-trimethyltellurobenzohydrazide), telluroesters (such as t-butyl-t-hexyltelluroester), colloidal tellurium, (di) tellurides and other tellurium compounds (such as potassium telluride and sodium telluropentathionate).

In noble metal sensitization, the salts of noble metals, such as gold, platinum, palladium and iridium, are used as sensitizer. The noble metal salts for such a purpose are described in, e.g., P. Glafkides, *Chimie et Physique Photographique*, 5th ed., Paul Montel (1087), and *Research Disclosure* vol. 307, No. 307105. In particular, gold sensitization is preferred. Examples of gold compounds suitable for gold sensitization include chloroauric acid, potassium chloroaurate, potassium aurithiocyanate, gold sulfide and gold selenide. In addition, the gold compounds disclosed in U.S. Pat. Nos. 2,642,361, 5,049,484 and 5,049,485 can also be used as gold sensitizer.

In reduction sensitization, reducing compounds are used as sensitizer. The reducing compounds for such a purpose are described in, e.g., P. Glafkides, *Chimie et Physique Photographique*, 5th ed., Paul Montel (1087), and *Research Disclosure* vol. 307, No. 307105. Examples of suitable reduction sensitizers which can be used include aminoiminomethanesulfinic acid (thiourea dioxide), borane compounds (such as dimethylamine borane), hydrazine compounds (such as hydrazine and p-tolylhydrazine), polyamine compounds (such as diethylenetriamine and triethylenetriamine), stannous chloride, silane compounds, reductones (such as ascorbic acid), sulfites, aldehyde compound and hydrogen. In addition, reduction sensitization can be carried out in an atmosphere of high pH or excess silver ions (the so-called silver ripening).

Two or more kinds of chemical sensitization may be carried out in combination. In particular, the combination of chalcogen sensitization and gold sensitization is preferred over the others. Further, it is desirable that the reduction sensitization be carried out in the step of forming silver halide grains. The amount of each sensitizer used is generally determined depending on what type of silver halide grains are sensitized and what condition is adopted for the chemical sensitization. Specifically, the amount of a chalcogen sensitizer used is generally from $10^{-8}$ to $10^{-2}$ mole, preferably from $10^{-7}$ to $5\times10^{-2}$ mole, per mole of silver halide. The amount of a noble metal sensitizer used is preferably from $10^{-7}$ to $10^{-2}$ mole per mole of silver halide. As to the conditions for chemical sensitization, there are no particular restrictions. However, it is desirable that the pAg be from 6 to 11, preferably from 7 to 10, the pH be from 4 to 10 and the temperature be from 40° C. to 95° C., preferably from 45° C. to 85° C.

The silver halide emulsions can contain a wide variety of compounds for purposes of preventing fogging or stabilizing photographic properties during production, storage or photographic processing of the photographic material. Examples of compounds usable for the foregoing purposes include azoles (such as benzothiazolium salts, nitroindazoles, triazoles, benzotriazoles, imidazoles and benzimidazoles (especially those substituted with nitro groups or halogen atoms)), heterocyclic mercapto compounds (such as mercaptothiazoles, mercaptobenzothiazoles, mercaptobenzimidazoles, mercaptothiadiazoles, mercaptotetrazoles (especially 1-phenyl-5-mercaptotetrazole) and mercaptopyrimidines), the above-recited heterocyclic mercapto compounds further containing a water-soluble group, such as a carboxyl or sulfo group, thioketo compounds (such as oxazolinethione), azaindene compounds (such as tetraazaindenes (especially 1,3, 3a,7-tetraazaindenes substituted with a hydroxyl group at the 4-position)), benzenethiosulfonic acids and benzenesulfinic acid. In general, these compounds are known as antifoggants or stabilizers.

The appropriate time for addition of such an antifoggant or stabilizer is generally after chemical sensitization. However, the time for addition may be chosen from any stages during or before chemical sensitization. Specifically, the antifoggants or stabilizers may be added during the addition of a silver salt solution in the process of forming silver halide emulsion grains, or during the period from the conclusion of addition of a silver salt solution to the beginning of chemical sensitization, or during chemical sensitization (preferably during the first half of chemical sensitization, more preferably during the period from the beginning of chemical sensitization to the time corresponding to one fifth of chemical sensitization time), The present silver halide photographic materials have no particular restrictions as to their layer structures. When they are color photographic materials, however, they have a multi-layer structure for recording blue light, green light and red light separately. Further, each silver halide emulsion layer may be constituted of two layers, a high speed layer and a low speed layer. Examples of a practical layer structure (1) to (6) are given below:

(1) BH/BL/GH/GL/RH/RL/S (2) BH/BM/BL/GH/GM/GL/RH/RM/RL/S (3) BH/BL/GH/RH//GL/RL/S (4) BH/GH/RH/BL/GL/RL/3

(5) BH/BL/CL/GH/GL/RH/RL/S (6) BH/BL/GH/GL/CL/RH/RL/S

Therein, B stands for a blue-sensitive layer, G for a green-sensitive layer, R for a red-sensitive layer, H for a highest speed layer, M for a medium speed layer, L for a low speed layer, S for a support, and CL for an interlayer effect-providing layer. Light-insensitive layers, such as a protective layer, a filter layer, an interlayer, an anti-halation layer and a subbing layer, are omitted from the foregoing representation of layer structures. Further, the arranging order of high-speed and low-speed layers having the same color sensitivity may be reversed. The layer structure (3) is described in U.S. Pat. No. 4,184,876. The layer structure (4) is described in *Research disclosure* vol. 225, No. 22534, JP-A-59-177551 and JP-A-59-177552. The layer structures (5) and (6) are described in JP-A-61-34541. Of these layer structures, the layer structures (1), (2) and (4) are preferred over the others. Besides color photographic materials, the silver halide photographic materials of the present invention can be applied to X-ray photographic materials, sensitive materials for black and white photography, sensitive materials for platemaking, and photographic printing paper.

For various additives usable in the silver halide emulsions (e.g., binders, chemical sensitizers, spectral sensitizers, stabilizers, gelatin, hardeners, surfactants, antistatic agents, polymer latexes, matting agents, color couplers, ultraviolet absorbents, discoloration inhibitors, supports usable in the photographic materials and sing methods applicable to the photographic materials coating methods, exposure methods, development-processing methods), the descriptions in *Research Disclosure* vol. 76, NO. 17643 (abbreviated as "RD-17643"), vol. 187, No 18176 (abbreviated as "RD-18716") and vol. 225, No. 22534 (abbreviated as "RD-22534") can be referred to. The locations where the additives are described in each of those references are listed below.

| Kinds of Additives | RD-17643 | RD-18716 | RD-22534 |
|---|---|---|---|
| 1. Chemical sensitizer | p. 23 | p. 648, right column | p. 24 |
| 2. Sensitivity increasing agent | | p. 648, right column | |
| 3. Spectral sensitizer and Supersensitizer | pp. 23–24 | p. 648, right column, to p. 649, right column | pp. 24–28 |
| 4. Brightening agent | p. 24 | | |
| 5. Antifoggant and Stabilizer | pp. 24–25 | p. 649, right column | p. 24 and p. 31 |
| 6. Light absorbent, Filter dye, UV Absorbent | pp. 25–26 | p. 649, right column, to p. 650, left column | |
| 7. Stain inhibitor | p. 25, right column | p. 650, left to right column | |
| 8. Dye image stabilizer | p. 25 | p. 32 | |
| 9. Hardener | p. 26 | p. 651, left column | p. 32 |
| 10. Binder | p. 26 | p. 651, left column | p. 28 |
| 11. Plasticizer, Lubricant | p. 27 | p. 650, right column | |
| 12. Coating aid, Surfactant | pp. 26–27 | p. 650, right column | |
| 13. Antistatic agent | p. 27 | p. 650, right column | |
| 14. Color coupler | p. 25 | p. 649 | p. 31 |

The color photographic materials of the present invention can be processed using the general methods described in *Research Disclosure* vol. 176, NO. 17643 and ibid. vol. 187, No. 18716. Specifically, the color photographic materials are subjected sequentially to development processing, bleach-fix processing or fixation processing, and washing or stabilization processing. In the washing step, a counter-current washing method using at least two tanks is generally adopted to effect a water saving. As a typical example of stabilization processing which can take the place of washing processing, the multistage counter-current stabilization processing as disclosed in JP-A-57-8543 can be exemplified.

The present invention will now be illustrated in greater detail by reference to the following examples, but it should be understood that these examples are not to be construed as limiting the scope of the invention in any way.

EXAMPLE 1

Preparation of Emulsion 1-1 (Cubic silver bromide Emulsion

To 870 ml of water, 36 g of deionized gelatin and 0.25 g of potassium bromide were added to prepare an aqueous gelatin solution. The aqueous gelatin solution was kept at 75° C. with stirring, and thereto 36 ml of a 0.088 M aqueous solution of silver nitrate (Solution 1) and 36 ml of a 0.088 M aqueous solution of potassium bromide (Solution 2) were added at a constant flow rate over a 10-minute period with a double jet method, and further 176 ml of Solution 1 and 176 ml of Solution 2 were added over a 7-minute period in accordance with a double jet method. Subsequently thereto, 898 ml of a 0.83 M aqueous solution of silver nitrate (Solution 3) was further added over a 90-minute period at an accelerated flow rate, beginning with the flow rate of 0.53 ml/min, and simultaneously therewith a 0.90 M aqueous solution of potassium bromide (Solution 4) was added while controlling the addtion rate so that the pBr was maintained at 4.66. Then, 90 ml of Solution 3 was further added over a 5-minute period at a constant flow rate. Simultaneously therewith, the aqueous solution of potassium bromide (Solution 5), the concentration of which was the same as that of Solution 4, was added while controlling the addtion rate so that the pBr was kept 4.66. After 5-minute lapse from the conclusion of the addition, the reaction solution was cooled to 35° C., and the soluble salts were removed therefrom by a general flocculation method. The resulting solution was raised again to 40° C., and additional gelatin in an amount of 50 g was dissolved thereinto. The emulsion thus prepared was admixed with potassium bromide and 2-phenoxyethanol, and adjusted to pH 6.5. The emulsion grains formed in the foregoing manner were monodispersed silver bromide cubes having an edge length of 0.5 $\mu$m.

Preparation of Comparative Emulsions 1-2, 1-3 and 1-4 (Cubic Silver Bromide Emulsions Doped with $[Fe(CN)_6]^{4-}$, $[Fe(EDTA)]^{2-}$ and $[Fe(CN)_5(DMSO)]^{3-}$ Respectively)

[Comparison]

Emulsions 1-2, 1-3 and 1-4 were prepared in the same manner as Emulsion 1-1, except that $[Fe(CN)_6]^{4-}$, $[Fe(EDTA)]^{2-}$ (EDTA=ethylene diaminetetra acetic acid) and $[Fe(CN)_5(DMSO)]_{3-}$ (DMSO=dimethyl sulfoxide) were added respectively to each of Solutions 4 and 5 in an amount of $1\times10^{-5}$ mole per mole of silver at the addition stage of these solutions.

Preparation of Present Emulsion 1-5 (Cubic Silver Bromide Emulsion Doped with Present Complex $[Ru(trz)_6]^{4-}$)

[Invention]

Emulsion 1-5 was prepared in the same manner as Emulsion 1-1, except that the complex $[Ru(trz)_6]^{4-}$ of the present invention was added to each of Solutions 4 and 5, respectively, in an amount of $1\times10^{-5}$mole per mole of silver added.

Each of the foregoing Emulsions 1-1 to 1-5 was admixed with $1.2\times10^{-4}$ mole/mole-Ag of sodium thiosulfate, and subjected to optimal chemical sensitization at 60° C. After admixed with gelatin and sodium dodecylbenzenesulfonate, each of these chemically sensitized emulsions was coated at a silver coverage of 2 g/m$^2$ using an extrusion method on a subbing layer-provided triacetyl cellulose film support together with a protective layer containing gelatin, polymethylmethacrylate particles and sodium salt of 2,4-dichloro-6-hydroxy-s-triazine. Thus, coated Samples 1-1a to 1-5a were prepared. Further, the foregoing chemically sensitized emulsions were each spectrally sensitized by the addition of $4.9\times10^{-4}$ mole/mole-Ag of the following Sensitizing Dye (1), and coated in the same manner as adopted for preparing the coated Samples 1-1a to 1-5a, thereby preparing coated Samples 1-1b to 1-5b respectively.

Sensitizing Dye (1)

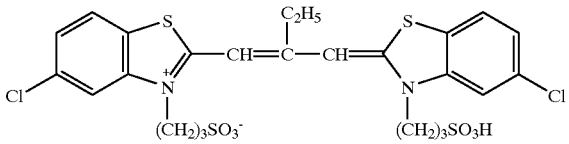

These Samples were each subjected to the exposure for sensitometry (1 second and 10 seconds) via an optical wedge, and then developed for 10 minutes at 20° C. with Developer 1 prepared according to the formula described below. Thereafter, each Sample underwent sequentially stop, fixation, washing and drying operations, and then measured for optical densities. The fog was determined as the minimum optical density of each sample, and the sensitivity was represented by the logarithm of an exposure amount required for providing the optical density of fog+0.1. The sensitivities of Samples are shown as relative values in Table 1, with the dopant-free Sample being taken as 100. With respect to the coated Samples 1-1a to 1-5a (spectral sensitizing dye-free samples), the sensitivity of each sample shown in Table 1 is relative sensitivity determined when the sample was exposed to light of wavelengths at which the silver halide therein showed the intrinsic absorption. On the other hand, the sensitivities of coated Samples 1-1b to 1-5b (spectral sensitizing dye-added samples) shown in Table 1 are relative sensitivities determined when the samples were exposed to light of wavelengths corresponding to the absorption by the spectral sensitizing dye.

| Developer 1 | |
|---|---|
| Metol | 2.5 g |
| L-Ascorbic acid | 10.0 g |
| Nabox | 35.0 g |
| KBr | 1.0 g |
| Water to make | 1 liter |
| pH adjusted to | 9.6 |

TABLE 1

| Sample No.*1 | Emulsion No. | Dopant* | Relative Sensitivity*2 One-second exposure | Relative Sensitivity*2 $10^{-3}$-second exposure |
|---|---|---|---|---|
| 1-1a (compar..) | 1-1 | not added | 100 | 100 |
| 1-2a (compar..) | 1-2 | $[Fe(CN)_6]^{4-}$ | 101 | 113 |
| 1-3a (compar..) | 1-3 | $[Fe(EDTA)]^{2-}$ | 103 | 100 |
| 1-4a (compar..) | 1-4 | $[Fe(CN)_5(DMSO)]^{3-}$ | 98 | 101 |
| 1-5a (invention) | 1-5 | $[Ru(trz)6]^{4-}$ | 107 | 109 |
| 1-1b (compar..) | 1-1 | not added | 100 | 100 |
| 1-2b (compar..) | 1-2 | $[Fe(CN)_6]^{4-}$ | 105 | 106 |
| 1-3b (compar..) | 1-3 | $[Fe(EDTA)]^{2-}$ | 106 | 104 |
| 1-4b (compar..) | 1-4 | $[Fe(CN)_5(DMSO)]^{3-}$ | 107 | 110 |
| 1-5b (invention) | 1-5 | $[Ru(trz)6]^{4-}$ ($1 \times 10^{-5}$ mol/mol Ag) | 122 | 106 |

*Symbols EDTA, DMSO and trz given to the ligands of the foregoing dopants stand for ethylenediaminetetraacetic acid, dimethyl sulfoxide and 1,2,4-triazole, respectively. As a note, the localized dopant concentration was appended to $[Ru(trz)6]^{4-}$.

*1Samples having "a" as the suffix of their sample Nos. are sensitizing dye-free samples, and those having "b" are sensitizing dye-added samples. The former samples were exposed to light of wavelengths corresponding to the intrinsic absorption of silver bromide, while the latter samples were exposed to light of wavelengths at which the sensitizing dye showed absorption.

*2Sensitivities shown as relative values, with Emulsion 1-1 being taken as 100 under each condition.

In Table 1 are shown the relative sensitivities of the emulsions doped with $[Ru(trz)_6]^{4-}$ of the present invention and the comparative emulsions doped with $[Fe(CN)_6]^{4-}$, $[Fe(EDTA)]^{2-}$ and $[Fe(CN)_5(DMSO)]^{3-}$, respectively. Each dopant was distributed uniformly inside the emulsion grains, excepting the core part. In both exposure cases, the emulsions doped with $[Ru(trz)_6]^{4-}$ according to the present invention had an increase in sensitivity. More specifically, the sensitivity increasing effect was greater in the case of one-second exposure than $10^{-3}$-second exposure, especially greater in the dye-added sample. Compared with the emulsions doped with $[Fe(CN)_6]^{4-}$ hitherto used as a dopant having sensitivity increasing effect, $[Fe(EDTA)]^{2-}$ disclosed in U.S. Pat. No. 3,672,901 and $[Fe(CN)_5(DMSO)]^{3-}$ disclosed in U.S. Pat. No. 5,360,712, respectively, the emulsions doped with $[Ru(trz)_6]^{4-}$ of the present invention were decidedly superior in sensitivity increasing effect in the case of one-second exposure, while almost equivalent or superior in the case of $10^{-3}$-second exposure. Additionally, the emulsion came to have internal sensitivity when the amount of $[Ru(trz)_6]^{4-}$ added was increased.

EXAMPLE 2

Preparation of Comparative Emulsion 2-1 (Cubic Silver Bromide Emulsion (2))

[Comparison]

Emulsion 2-1 was prepared in the same manner as the Emulsion 1-1 in Example 1.

Preparation of Present Emulsions 2-2 to 2-9 (Cubic Silver Bromide Emulsions (1) Doped with Present Pyrazole, Imidazole and Triazole Complexes Respectively)

[Invention]

Emulsions 2-2 to 2-8 were prepared in the same manner as Emulsion 1-1 in Example 1, except that $[Fe(pz)_6]^{2+}$ (pz=pyrazole), $[Zn(pz)_6]^{2+}$, $[Mg(pz)_6]^{2+}$, $[Fe(Im)_6]^{2+}$ (Im=imidazole), $[Zn(Im)_6]^{2+}$, $[Mg(Im)_6]^{2+}$ and $[Fe(trz)]^{2+}$ (trz=1,2,4-triazole) according to the invention were added respectively to Solution 5 in an amount of $1\times10^{-5}$ mole per mole of silver at the addition stage of this solution. Further, Emulsion 2-9 also was prepared in the same manner as the foregoing Emulsions, except that $[Ru(trz)_6]^{4-}$ was added to Solution 5 in an amount of $5\times^{-5}$ mole per mole of silver at the addition stage of this solution.

Each of the cubic silver bromide Emulsions 2-1 to 2-9 was admixed with $1.2\times^{-4}$ mole/mole-Ag of sodium thiosulfate, and subjected to optimal chemical sensitization at 60° C. These emulsions were each coated in the same process as used for Emulsions 1-1 to 1-5 of Example 1 to prepare coated Samples 2-1a to 2-9a. Further, those chemically sensitized emulsions were each spectrally sensitized by the addition of $4.9\times10^{-4}$ mole/mole-Ag of the same Sensitizing Dye (1) as used in Example 1, and coated in the same manner as mentioned above, thereby preparing coated Samples 2-1b to 2-9b, respectively.

These Samples were each subjected to the same exposure and photographic processing as carried out in Example 1, and examined for relative sensitivities. In Table 2 are set forth the relative sensitivities of the coated Samples 2-1a to 2-9a (spectral sensitizing dye-free samples) which were determined by exposure to light of wavelengths at which the silver halide therein showed the intrinsic absorption and the relative sensitivities of coated Samples 2-1b to 2-9b (spectral sensitizing dye-added samples) which were determined by exposure to light of wavelengths corresponding to the absorption by the spectral sensitizing dye.

TABLE 2

| Sample No.*1 | Emulsion No. | Dopant* | Relative Sensitivity*2 One-second exposure | Relative Sensitivity*2 $10^{-3}$-second exposure |
|---|---|---|---|---|
| 2-1a (compar.) | 2-1 | not added | 100 | 100 |
| 2-2a (invention) | 2-2 | $[Fe(pz)_6]^{2+}$ | 113 | 110 |
| 2-3a (invention) | 2-3 | $[Zn(pz)_6]^{2+}$ | 111 | 110 |
| 2-4a (invention) | 2-4 | $[Mg(pz)_6]^{2+}$ | 112 | 109 |
| 2-5a (invention) | 2-5 | $[Fe(Im)_6]^{2+}$ | 112 | 109 |
| 2-6a (invention) | 2-6 | $[Zn(Im)_6]^{2+}$ | 110 | 108 |
| 2-7a (invention) | 2-7 | $[Mg(Im)_6]^{2+}$ | 111 | 108 |
| 2-8a (invention) | 2-8 | $[Fe(trz)_6]^{2+}$ | 105 | 106 |
| 2-9a (invention) | 2-9 | $[Ru(trz)_6]^{4-}$ | 121 | 115 |
| 2-1b (compar.) | 2-1 | not added | 100 | 100 |
| 2-2b (invention) | 2-2 | $[Fe(pz)_6]^{2+}$ | 116 | 111 |
| 2-3b (invention) | 2-3 | $[Zn(pz)_6]^{2+}$ | 116 | 116 |
| 2-4b (invention) | 2-4 | $[Mg(pz)_6]^{2+}$ | 115 | 113 |
| 2-5b (invention) | 2-5 | $[Fe(Im)_6]^{2+}$ | 125 | 116 |
| 2-6b (invention) | 2-6 | $[Zn(Im)_6]^{2+}$ | 123 | 114 |
| 2-7b (invention) | 2-7 | $[Mg(Im)_6]^{2+}$ | 124 | 118 |
| 2-8a (invention) | 2-8 | $[Fe(trz)_6]^{2+}$ | 127 | 119 |
| 2-9b (invention) | 2-9 | $[Ru(trz)_6]^{4-}$ | 140 | 154 |

*Symbols pz, Im and trz given to the ligands of the foregoing dopants stand for pyrazole, imidazole and 1,2,4-triazole, respectively.
*1Samples having "a" as the suffix of their sample Nos. are sensitizing dye-free samples, and those having "b" are sensitizing dye-added samples. The former samples were exposed to light of wavelengths corresponding to the intrinsic absorption of silver bromide, while the latter samples were exposed to light of wavelengths at which the sensitizing dye showed absorption.
*2Sensitivities shown as relative values, with Emulsion 2-1 being taken as 100 under each condition.

With respect to the emulsions according to the present invention, each dopant was added to the surface layer having a volume corresponding to 10% of the total volume of each emulsion grain.

As is apparent from the results of Table 2, the complexes having imidazole ligands had greater sensitivity increasing effect than those having pyrazole ligands. In the complexes containing triazole ligands, the emulsions doped with $[Ru(trz)_6]^{4-}$ showed a great increase in sensitivity; while, only when the spectral sensitizing dye was added to each emulsion, the sensitivity rise of the emulsion doped with $[Fe(trz)_6]^{4-}$ was equivalent to those of the emulsions doped with the complexes having imidazole ligands. Additionally, when each of the foregoing emulsions was doped with a greater amount of complex than used above, the resulting emulsion came to have clear internal sensitivity and thereby the surface sensitivity thereof was lowered.

Although the emulsions comprising cubic silver chloride grains were doped under the same conditions as mentioned above, no changes in photographic characteristics were observed.

EXAMPLE 3

Preparation of Emulsion 3-1 (Octahedral Silver Bromide Emulsion Sample (1)

To 870 ml of water, 36 g of deionized gelatin and 0.25 g of potassium bromide were added to prepare an aqueous gelatin solution. The aqueous gelatin solution was kept at 75° C. with stirring, and thereto 36 ml of a 0.088 M aqueous solution of silver nitrate (Solution 6) and 36 ml of a 0.088 M aqueous solution of potassium bromide (Solution 7) were added at a constant flow rate over a 10-minute period with a double jet method, and further 176 ml of Solution 6 and 176 ml of Solution 7 were added over a 7-minute period with a double jet method. Subsequently thereto, 898 ml of a 0.82 M aqueous solution of silver nitrate (Solution 8) was further added over a 90-minute period at an accelerated flow rate, beginning with the flow rate of 0.53 ml/min, and simultaneously therewith a 0.90 M aqueous solution of potassium bromide (Solution 9) was added while controlling the addition rate so that the pBr was maintained at 2.93. Then, 90 ml of Solution 8 was further added over a 5-minute period at a constant flow rate. Simultaneously therewith, the aqueous solution of potassium bromide (Solution 10), the concentration of which was the same as that of Solution 9, was added while controlling the addition rate so that the pBr was kept 2.93. After 5-minute lapse from the conclusion of the addition, the reaction solution was cooled to 35° C., and the soluble salts were removed therefrom by a general flocculation method. The resulting solution was raised again to 40° C., and additional gelatin in an amount of 50 g was dissolved therein. The emulsion thus prepared was admixed with potassium bromide and 2-phenoxyethanol, and adjusted to pH 6.5. The emulsion grains formed in the foregoing manner were monodispersed silver bromide octahedrons having an edge length of 0.5 $\mu$m.

Preparation of Comparative Emulsions 3-2, 3-3 and 3-4 (Octahedral Silver Bromide Emulsions Doped with $[Fe_2(CN)_6]^{4-}$, $[(Fe(CN)_5(DMSO)]^{3-}$ and $[Fe_2(CN)_{10}(\mu\text{-}4,4'\text{-bpy})]^{3-}$ (4,4'-bpy=4,4'-bipyridine), Respectively)

[Comprison]

Emulsions 3-2, 3-3 and 3-4 were prepared in the same manner as Emulsion 3-1, except that $[Fe(CN)_6]^{4-}$, $[Fe(CN)_5(DMSO)]^{3-}$ (DMSO=dimethyl sulfoxide) and $[Fe_2(CN)_{10}(\mu\text{-}4,4'\text{-bpy})]^{3-}$ were added respectively to the Solution 10 in an amount of $1\times10^{-4}$ mole per mole of silver at the addition stage of this solution.

Preparation of Present Emulsions 3-5 to 3-9 (Octaheddral Silver Bromide Emulsions Doped with Present Complexes Respectively)

[Invention]

Emulsions 3-5 to 3-9 were prepared in the same manner as Emulsion 3-1, except that $[Fe(pz)_6]^{2+}$ (pz=pyrazole), $[Fe(Im)_6]^{2+}$ (Im=imidazole), $[Zn(Im)_6]^{2+}$, $[Mg(Im)_6]^{2+}$ and $[Ru(trz)_6]^{4-}$ (trz=1,2,4-triazole) according to the present invention were added respectively to Solution 10 in an amount of $1\times10^{-4}$ mole per mole of silver at the addition stage of this solution.

Each of the silver bromide Emulsions 3-1 to 3-9 was admixed with $8.0'10^{-6}$ mole/mole-Ag of sodium thiosulfate, $9.6\times10^{-6}$ mole/mole-Ag of chloroauric acid and $3.4\times10^{-4}$ mole/mole-Ag of potassium thiocyanate, and subjected to optimal chemical sensitization at 60° C. After admixed with gelatin and sodium dodecylbenzenesulfonate, each of these chemically sensitized emulsions was coated at a silver coverage of 2 g/m$^2$ using an extrusion method on a subbing layer-provided triacetyl cellulose film support together with a protective layer containing gelatin, polymethylmethacrylate particles and sodium salt of 2,4-dichloro-6-hydroxy-s-triazine. Thus, coated Samples 3-1a to 3-9a were prepared. Further, the coated Samples 3-1b to 3-9b were prepared by spectrally sensitizing the foregoing chemically sensitized emulsions 3-1a to 3-9a respectively by the addition of $4.9\times10^{-4}$ mole/mole-Ag of the same Sensitizing Dye (1) as used in Example 1, and coating the resulting emulsions respectively in the same manner as adopted in Example 1.

These Samples were each subjected to the exposure for sensitometry (1 second and 10 seconds) via an optical wedge, and then developed for 10 minutes at 20° C. with the same Developer 1 prepared in Example 1. Thereafter, each Sample underwent sequentially stop, fixation, washing and drying operations, and then measured for optical densities. The fog was determined as the minimum optical density of each sample, and the sensitivity was represented by the logarithm of an exposure amount required for providing the optical density of fog+0.1. The sensitivities of Samples are shown as relative values in Table 3, with the dopant-free Sample (referred to as "type sample" also) being taken as 100. With respect to the coated Samples 3-1a to 3-9a (spectral sensitizing dye-free samples), the sensitivity of each sample shown in Table 3 is relative sensitivity determined when the sample was exposed to light of wavelengths at which the silver halide therein showed the intrinsic absorption. On the other hand, the sensitivities of coated Samples 3-1b to 3-9b (spectral sensitizing dye-added samples) shown in Table 3 are relative sensitivities determined when the samples were exposed to light of wavelengths corresponding to the absorption by the spectral sensitizing dye.

TABLE 3

| Sample No.*1 | Emulsion No. | Dopant* | Relative Sensitivity*2 One-second Exposure | Relative Sensitivity*2 $10^{-3}$-second exposure |
|---|---|---|---|---|
| 3-1a (compar.) | 3-1 | not added | 100 | 100 |
| 3-2a (compar.) | 3-2 | $[Fe(CN)_6]^{4-}$ | 102 | 104 |
| 3-3a (compar.) | 3-3 | $[Fe(CN)_5(DMSO)]^{3-}$ | 96 | 97 |
| 3-4a (compar.) | 3-4 | $[Fe_2(CN)_{10}(\mu\text{-}4.4'\text{-bpy})]^{6-}$ | 100 | 100 |
| 3-5a (invention) | 3-5 | $[Fe(pz)_6]^{2+}$ | 101 | 101 |
| 3-6a (invention) | 3-6 | $[Fe(Im)_6]^{2+}$ | 102 | 102 |
| 3-7a (invention) | 3-7 | $[Zn(Im)_6]^{2+}$ | 100 | 101 |
| 3-8a (invention) | 3-8 | $[Mg(Im)_6]^{2+}$ | 100 | 100 |
| 3-9a (invention) | 3-9 | $[Ru(trz)_6]^{4-}$ | 107 | 103 |
| 3-1b (compar.) | 3-1 | not added | 100 | 100 |

TABLE 3-continued

| Sample No.*1 | Emulsion No. | Dopant* | Relative Sensitivity*2 One-second Exposure | Relative Sensitivity*2 $10^{-3}$-second exposure |
|---|---|---|---|---|
| 3-2b (compar.) | 3-2 | $[Fe(CN)_6]^{4-}$ | 110 | 123 |
| 3-3b (compar.) | 3-3 | $[Fe(CN)_5(DMSO)]^{3-}$ | 111 | 119 |
| 3-4b (compar.) | 3-4 | $[Fe_2(CN)_{10}(\mu\text{-}4.4'\text{-bpy})]^{6-}$ | 114 | 125 |
| 3-5b (invention) | 3-5 | $[Fe(pz)_6]^{2+}$ | 109 | 108 |
| 3-6b (invention) | 2-6 | $[Fe(Im)_6]^{2+}$ | 108 | 106 |
| 3-7b (invention) | 3-7 | $[Zn(Im)_6]^{2+}$ | 116 | 114 |
| 3-8b (invention) | 3-8 | $[Mg(Im)_6]^{2+}$ | 100 | 108 |
| 3-9b (invention) | 3-9 | $[Ru(trz)_6]^{4-}$ | 114 | 109 |

*Symbols DMSO, $\mu$-4,4'-bpy, pz, Im and trz given to the ligands of the foregoing dopants stand for dimethyl sulfoxide, $\mu$-4,4'-bipyridine, pyrazole, imidazole and 1,2,4-triazole, respectively.

*1Samples having "a" as the suffix of their sample Nos. are sensitizing dye-free samples, and those having "b" are sensitizing dye-added samples. The former samples were exposed to light of wavelengths corresponding to the intrinsic absorption of silver bromide, while the latter samples were exposed to light of wavelengths at which the sensitizing dye showed absorption.

*2Sensitivities shown as relative values, with Emulsion 3-1 being taken as 100 under each condition.

The relative sensitivities of octahedral silver bromide emulsions doped with various complexes are shown in Table 3. Considered from the case of $[Fe(CN)_6]^{4-}$, it is anticipated that doping the emulsion with each complex is difficult under the condition of low pBr. However, the emulsions doped with the present complexes had higher sensitivities than the dopant-free emulsion. More specifically, the emulsions doped with $[Zn(Im)_6]^{2+}$ or $[Ru(trz)_6]^{4-}$ had a greater increase in sensitivity than the others. In particular, even when no spectral sensitizing dye was added, the emulsion doped with $[Ru(trz)_6]^{4-}$ showed a significant increase in sensitivity. Similarly to the case of cubic silver bromide emulsions, these emulsions showed greater sensitivity increasing effect upon one-second exposure than $10^{-3}$ second exposure, especially when the spectral sensitizing dye was added thereto. Compared with the emulsion doped with $[Fe(CN)_6]^{4-}$ or the emulsion doped with $[Fe(CN)_5(DMSO)]^{3-}$ or $[Fe_2(CN)_{10}(\mu\text{-}4,4'\text{-bpy})]^{3-}$ disclosed in U.S. Pat. No. 5,360,712, the emulsions doped with the present $[Fe(Im)_6]^{2+}$, $[Zn(Im)_6]^{2+}$and $[Ru(trz)_6]^{4-}$ of the present invention, respectively were almost equivalent or above in photographic speed in the case of one-second exposure, in spite of the absence of CN ions, while they were inferior in the case of $10^{-3}$-second exposure.

EXAMPLE 4

Preparation of Emulsion 4-1 (Octahedral Silver Bromide Emulsion Sample (2))

To 870 ml of water, 36 g of deionized gelatin and 0.25 g of potassium bromide were added to prepare an aqueous gelatin solution. The aqueous gelatin solution was kept at 75° C. with stirring, and thereto 36 ml of a 0.088 M aqueous solution of silver nitrate (Solution 6) and 36 ml of a 0.088 M aqueous solution of potassium bromide (Solution 7) were added at a constant flow rate over a 10-minute period with a double jet method, and further 176 ml of Solution 6 and 176 ml of Solution 7 were added over a 7-minute period with a double jet method. Subsequently thereto, 898 ml of a 0.82 M aqueous solution of silver nitrate (Solution 8) was further added over a 90-minute period at an accelerated flow rate, beginning with the flow rate of 0.53 ml/min, and simultaneously therewith a 0.90 M aqueous solution of potassium bromide (Solution 9) was added while controlling the addition rate so that the pBr was maintained at 2.93. Then, 63 ml of Solution 8 was further added over a 3.5-minute period at a constant flow rate. Simultaneously therewith, Solution 9 was added while controlling the addition rate so that the pBr was kept at 2.93. Furthermore, 27 ml of solution 8 was added over a 1.5-minute period at a constant flow rate, and at the same time was added the aqueous solution of potassium bromide (Solution 10), the concentration of which was the same as that of Solution 9, while controlling the addition rate so that the pBr was kept 2.93. After 5-minute lapse from the conclusion of the addition, the reaction solution was cooled to 35° C., and the soluble salts were removed therefrom by a general flocculation method. The resulting solution was raised again to 40° C., and additional gelatin in an amount of 50 g was dissolved therein. The emulsion thus prepared was admixed with potassium bromide and 2-phenoxyethanol, and adjusted to pH 6.5. The emulsion grains formed in the foregoing manner were monodispersed silver bromide octahedrons having an edge length of 0.5 $\mu$m.

Preparation of Present Emulsions 4-1 and 4-3 (Octaheddral Silver Bromide Emulsions Doped with Present Complexes $[Zn(Im)_6]^{3+}$ and $[Ru(trz)_6]^{4-}$ Respectively)

[Invention]

Emulsions 4-2 and 4-3 were prepared in the same manner as Emulsion 4-1, except that $[Zn(Im)_6]^{2+}$ and $[Ru(trz)_6]^{4-}$ according to the present invention were added respectively to Solution 10 in an amount of $1\times10^{-5}$ mole per mole of silver at the addition stage of this solution.

Each of the silver bromide Emulsions 4-1 to 4-3 was admixed with $8.0\times10^{-6}$ mole/mole-Ag of sodium thiosulfate, $9.6\times10^{-6}$ mole/mole-Ag of chloroauric acid and $3.4\times10^{-4}$ mole/mole-Ag of potassium thiocyanate, and subjected to optimal chemical sensitization at 60° C. Each of these chemically sensitized emulsions was coated in the same manner as in Example 3 to prepare the coated Samples 4-1a to 4-3a. Further, the coated Samples 4-1b to 4-3b were prepared by spectrally sensitizing the foregoing chemically sensitized emulsions 4-1a to 4-3a respectively by the addition of $4.9\times10^{-4}$ mole/mole-Ag of the same Sensitizing Dye (1) as used in Example 1, and coating the resulting emulsions respectively in the same manner as adopted for the coated Samples 4-1a to 4-3a.

These Samples were each subjected to the same exposure and photographic processing as carried out in Example 3, and examined for relative sensitivities. In Table 4 are set forth the relative sensitivities of the coated Samples 4-1a to 4-3a (spectral sensitizing dye-free samples) which were determined by exposure to light of wavelengths at which the silver halide therein showed the intrinsic absorption and the relative sensitivities of coated Samples 4-1b to 4-3b (spectral sensitizing dye-added samples) which were determined by exposure to light of wavelengths corresponding to the absorption by the spectral sensitizing dye.

TABLE 4

| Sample No.*1 | Emulsion No. | Dopant* | Relative Sensitivity*2 One-second exposure | Relative Sensitivity*2 $10^{-3}$-second exposure |
|---|---|---|---|---|
| 4-1a (compar.) | 4-1 | not added | 100 | 100 |
| 4-2a (invention) | 4-2 | $[Zn(Im)_6]^{2+}$ | 109 | 105 |
| 4-3a (invention) | 4-3 | $[Ru(trz)_6]^{4-}$ | 112 | 107 |
| 4-1b (compar.) | 4-1 | not added | 100 | 100 |
| 4-2b (invention) | 4-2 | $[Zn(Im)_6]^{2+}$ | 129 | 118 |
| 4-3b (invention) | 4-3 | $[Ru(trz)_6]^{4-}$ | 125 | 113 |

*Symbols trz and Im given to the ligands of the foregoing dopants stand for 1,2,4-triazole and imidazole, respectively.

*1Samples having "a" as the suffix of their sample Nos. are sensitizing dye-free samples, and those having "b" are sensitizing dye-added samples. The former samples were exposed to light of wavelengths corresponding to the intrinsic absorption of silver bromide, while the latter samples were exposed to light of wavelengths at which the sensitizing dye showed absorption.

*2Sensitivities shown as relative values, with Emulsion 4-1 being taken as 100 under each condition.

With respect to the octahedrl silver bromide emulsion (2), the dopants $[Zn(Im)_6]^{2+}$ and $[Ru(trz)_6]^{4-}$ were each added to the surface layer having a volume corresponding to 3% of the total volume of each emulsion grain.

As is apparent from the results of Table 4, all the doped emulsions had higher sensitivity than the undoped emulsion, and therein no clear internal sensitivity was observed. In addition, similarly to the results obtained in the aforementioned Examples, the spectral sensitizing dye-added samples had a greater increase in sensitivity than the spectral sensitizing dye-free samples.

EXAMPLE 5

Preparation of Emulsion 5-1 (Octahedral Silver Bromide Emulsion Sample (3))

Emulsion 5-1 was prepared in the same manner as employed for preparation of Emulsion 3-1 in Example 3.

Preparation of Present Emulsions 5-2 to 5-5 (Octahedral Silver Bromide Emulsions Doped with $[Ru(Hdpa)_3]^{2+}$ $[Ru(bpy)_2dcbpy)]^{2+}$ $[Ru(dsbpy)_3]^{2+}$ and $[Ru(hq)_3]^{-}$ Respectively)

[Invention]

Emulsions 5-2 to 5-5 were prepared in the same manner as Emulsion 5-1, except that $[Ru(Hdpa)_3]^{2+}$ (Hdpa=2,2'-dipyridylamine), $[Ru(bpy)_2(dcbpy)]^{2+}$ (bpy=2,2'-bipyridine, dcbpy=4,4'-dicarboxy-2,2'-bipyridine), $[Ru(dsbpy)_3]^{2+}$ (bsbpy=2,2'-bipyridine-4,4'-disulfonic acid) and $[Ru(hq)_3]^{-}$ (hq=8-hydroxyquinoline) according to the present invention were added respectively to each of Solutions 9 and 10 in an amount of $2.5\times10^{-4}$ mole per mole of silver at the addition stage of each solution.

Each of the silver bromide Emulsions 5-1 to 5-5 was admixed with $8.0\times10^{-6}$ mole/mole-Ag of sodium thiosulfate, $9.6\times10^{-6}$ mole/mole-Ag of chloroauric acid and $3.4\times10^{-4}$ mole/mole-Ag of potassium thiocyanate, and subjected to optimal chemical sensitization at 60° C. Each of these emulsions was spectrally sensitized with $4.9\times10^{-4}$ mole/mole-Ag of the same sensitizing dye (1) as used in Example 1, and coated in the same manner as in Example 3 to prepare the coated Samples 5-1 to 5-5.

These Samples were each subjected to the same exposure and photographic processing as carried out in Example 3, and examined for relative sensitivities. In Table 5 are set forth the relative sensitivities of the coated Samples 5-1 to 5-5 (spectral sensitizing dye-added samples) which were determined by exposure to light of wavelengths corresponding to the absorption by the spectral sensitizing dye.

TABLE 5

| Sample No.*1 | Emulsion No. | Dopant* | Relative Sensitivity*2 One-second exposure | Relative Sensitivity*2 $10^{-3}$-second exposure |
|---|---|---|---|---|
| 5-1 (compar.) | 5-1 | not added | 100 | 100 |
| 5-2 (invention) | 5-2 | $[Ru(Hdpa)_3]^{2+}$ | 178 | 166 |
| 5-3 (invention) | 5-3 | $[Ru(bpy)_2(dcbpy)]^{2+}$ | 162 | 157 |
| 5-4 (invention) | 5-4 | $[Ru(dsbpy)_3]^{2+}$ | 154 | 147 |
| 5-5 (invention) | 5-5 | $[Ru(hq)_3]^-$ | 160 | 150 |

*As to the symbols given to the ligands of the foregoing dopants, Hdpa stands for 2,2'-dipyridylamine, bpy for 2,2'-bipyridine, dcbpy for 4,4'-dicarboxy-2,2'-bipyridine, dsbpy for 2,2'-bipyridine-4,4'-disulphonic acid, and hq for 8-hydroxyquinoline.
*1All the samples are sensitizing dye-added samples, and exposed to light of wavelengths at which the sensitizing dye showed absorption.
*2Sensitivities shown as relative values, with Emulsion 5-1 being taken as 100 under each condition.

In Table 5 are shown the relative sensitivities of the emulsions comprising octahedral silver bromide grains doped uniformly with each of the complexes. As is apparent from the results of Table 5, every doped emulsion showed a remarkable increase in sensitivity to light of wavelengths corresponding to the color sensitization region, although no appreciable change in sensitivity was observed when no sensitizing dye was added thereto. The sensitivity increase achieved by each of the present dopands greatly exceeded those obtained by conventional dopants. Moreover, the sensitivity increasing effect of those dopants according to the present invention was greater in the case of uniformly doping throughout the emulsion grains than in the case of doping only the surface layer of emulsion grains.

EXAMPLE 6

Preparation of Emulsion 6-1 (Emulsion Comprising Tabular Silver Iodobromide Grains having (111) Face as Main Plane)

In a reaction vessel was placed 1 liter of a dispersing medium solution (pH=5) containing 0.38 g of KBr and 0.5 g of low molecular weight gelatin (molecular weight: 15,000), and kept at 40° C. To this solution with stirring, 20 ml of a 0.29 M silver nitrate solution and 20 ml of a 0.29 M KBr solution were added over a 40-second period with a double jet method. After the addition, 15 minutes were spent in heating the resulting admixture up to 75° C. After a 15-minute lapse from such a heating operation, a dispersing medium solution containing 35 of alkali-processed gelatin and 250 ml of water was further added. After adjusting the pH to 6.0, 734 ml of a 1.2 M silver nitrate solution was added at an accelerated flow rate. During this period, a mixture of KBr and KI solutions was added simultaneously with the silver nitrate solution at such a flow rate as to keep the pBr at 2.93. Therein, the KI and KBr solutions were added in such amounts that the $I^-$ concentration was 3 mole % based on the amount of silver added.

Preparation of Comparative Emulsion 6-2 (Tabular Iodobromide Silver Emulsion Doped with $[Ru(CN)_6]^{4-}$)

[Comparison]

A comparative Emulsion 6-2 was prepared as described for Emulsion 6-1 except that the dopant solution was modified to introduce a total of $1\times10^{-4}$ mole per mole of Ag of $[Ru(CN)_6]^{4-}$ in the outer 80% to 100% of the grain volume.

Preparation of Present Emulsions 6-3 to 6-5 (Tabular Iodobromide Silver Emulsions Doped with $[Ru(trz)_6]^{4-}$, $[Ru(Hdpa)_3]^{2+}$ and $[Ru(hq)_3]^-$ Respectively)

[Invention]

Emulsions 6-3 to 6-5 according to the present invention were prepared by doping Emulsion 6-1 by the addition of $[Ru(trz)_6]^{4-}$, $[Ru(Hdpa)_3]^{2+}$ and $[Ru(hq)_3]^-$ in amounts of $1\times10^{-4}$ mole, $5\times10^{-4}$ mole and $2.5\times10^{-4}$ mole, respectively, per mole of silver contained in the total emulsion grains so that each emulsion grain was doped with the foregoing complex in the region corresponding to 80–100% of its volume.

Each of the Emulsions 6-1 to 6-5 was admixed with $8.0\times10^{-6}$ mole/mole-Ag of sodium thiosulfate, $3\times10^{-6}$ mole/mole-Ag of chloroauric acid and $3\times10^{-6}$ mole/mole-Ag of potassium thiocyanate, and subjected to optimal chemical sensitization at 60° C. Each of these chemically sensitized emulsions was coated in the same manner as in Example 3 to prepare the coated Samples 6-1 to 6-5.

These samples were each subjected to the exposure for sensitometry ($10^{-2}$ second) via an optical wedge, and then developed in the same manner as in Example 3, and further subjected to conventional stop, fixation, washing and drying operations, followed by examination of optical densities. In Table 6 are set forth the relative sensitivities of the coated Samples 6-1 to 6-5 (spectral sensitizing dye-free samples) which were determined by exposure to light of wavelengths at which the silver halide therein showed the intrinsic absorption.

TABLE 6

| Sample No. | Emulsion No. | Dopant* | Amount added (mol/mol Ag) | Relative sensitivity*1 ($10^{-2}$-second exposure) |
|---|---|---|---|---|
| 6-1 (compar.) | 6-1 | not added | — | 100 |
| 6-2 (compar.) | 6-2 | $[Ru(CN)_6]^{4-}$ | $1\times10^{-4}$ | 105 |
| 6-3 (invention) | 6-3 | $[Ru(trz)_6]^{4-}$ | $1\times10^{-4}$ | 114 |
| 6-4 (invention) | 6-4 | $[Ru(Hdpa)_3]^{2+}$ | $5\times10^{-4}$ | 125 |
| 6-5 (invention) | 6-5 | $[Ru(hq)_3]^-$ | $2.5\times10^{-4}$ | 118 |

*As to the symbols given to the ligands of the foregoing dopants, trz stands for 1,2,4-trizole, Hdpa for 2,2'-dipyridylamine and hq for 8-hydroxyquinoline.
*1Sensitivities shown as relative values, with Emulsion 6-1 being taken as 100 under each condition.

$[Ru(trz)_6]^{4-}$, $[Ru(Hdpa)_3]^{30}$ and $[Ru(hq)_3]^-$, which have proved to be highly effective in increasing the sensitivity of octahedral silver halide emulsion by the foregoing Examples, were used for doping in this Example. The emulsions doped with these complexes had distinctly greater sensitivity-increasing effect than the emulsion doped with $[Ru(CN)_6]^{4-}$. Further, the sensitivity difference between each of the emulsions doped with the present complexes and the undoped emulsion or the emulsion doped with $[Ru(CN)_6]^{4-}$ was greater in the high optical density region than the other regions, so the dope with the complexes of the present invention gave also high contrast to the emulsion. In addition, the maximum densities provided by the emulsions doped with the complexes of the present invention were higher than those provided by the undoped emulsion and the emulsion doped with $[Ru(CN)_6]^{4-}$.

EXAMPLE 7

Preparation of Emulsion 7-1 (Octahedral Silver Bromide Emulsion Sample (1))

An Emulsion 7-1 was prepared in the same manner as Emulsion 3-1 prepared in Example 3. The emulsion grains obtained were monodispersed silver bromide octahedrons having an edge length of 0.5 μm.

Preparation of Comparative Emulsions 7-2 to 7-6 (Octahedral Silver Bromide Emulsions Doped with $[Fe(CN)_6]^{4-}$, $[Fe(CN)_5(DMSO)]^{3-}$, $[Fe(CN)_5(\mu\text{-}4,4'\text{-bpy})]^{3-}$, $[Ru(CN)_5(MTP)]^{3-}$ and $[Fe(EDTA)]^{2-}$ Respectively)

[Comparison]

Emulsions 7-2, 7-3, 7-4, 7-5 and 7-6 were prepared in the same manner as Emulsion 3-1, except that $[Fe(CN)_6]^{4-}$, $[Fe(CN)_5(DMSO)]^{3-}$ (DMSO=dimethyl sulfoxide) and $[Fe(CN)_5(\mu\text{-}4,4'\text{-bpy})]^{3-}$ (μ-4,4'-bpy=μ-4,4'-bipyridine), $[Ru(CN)_5(MTP)]^{3-}$ (MTP=5-methyl-s-triazolo(1.5-A) pyrimidine-7-ol) and $[Fe(EDTA)]^{2-}$ (EDTA= ethylenediaminetetraacetic acid) were added respectively to the Solution 10 in an amount of $1\times10^{-4}$ mole per mole of silver at the addition stage of this solution the present invention were added respectively to Solution 10 in an amount of $1\times10^{-5}$ mole per mole of silver at the addition stage of this solution.

The foregoing silver bromide Emulsions 7-1 to 7-12 were each chemically sensitized and coated in the same manner as in Example 3, thereby preparing coated Samples 7-1a to 7-12a respectively. Further, the coated Samples 7-1b to 7-12b were prepared by spectrally sensitizing the foregoing chemically sensitized emulsions respectively by the addition of $4.9\times10^{-4}$ mole/mole-Ag of the same Sensitizing Dye (1) as used in Example 1, and coating the resulting emulsions respectively in the same manner as adopted for preparing the coated Samples 7-1a to 7-12a.

These Samples were each subjected to the same exposure and photographic processing as in Example 3. The results obtained are shown in Table 7.

TABLE 7

| Sample No.*1 | Emulsion No. | Dopant* | Relative Sensitivity*2 One-second exposure | Relative Sensitivity*2 $10^{-3}$-second exposure |
|---|---|---|---|---|
| 7-1a (compar.) | 7-1 | not added | 100 | 100 |
| 7-2a (compar.) | 7-2 | $[Fe(CN)_6]^{4-}$ | 102 | 104 |
| 7-3a (compar.) | 7-3 | $[Fe(CN)_5(DMSO)]^{3-}$ | 96 | 97 |
| 7-4a (compar.) | 7-4 | $[Fe(CN)_5(\mu\text{-}4,4'\text{-bpy})]^{3-}$ | 100 | 100 |
| 7-5a (compar.) | 7-5 | $[Ru(CN)_5(MTP)]^{3-}$ | 102 | 105 |
| 7-6a (compar.) | 7-6 | $[Fe(EDTA)]^{2-}$ | 101 | 100 |
| 7-7a (invention) | 7-7 | $[Ru(thia)_6]^{2+}$ | 116 | 111 |
| 7-8a (invention) | 7-8 | $[Ru(pyz)_6]^{2+}$ | 115 | 109 |
| 7-9a (invention) | 7-9 | $[RU(bpy)_2(4,4'\text{-bpy})_2]^{2-}$ | 104 | 102 |
| 7-10a (invention) | 7-10 | $[Ru(bpy)_2(4,4'\text{-bpy})Cl]^{+}$ | 110 | 109 |
| 7-11a (invention) | 7-13 | $[Ru(bpy)_2(5\text{-}NH_2\text{phen})]^{2+}$ | 116 | 112 |
| 7-12a (invention) | 7-14 | $[Ru(bpy)_2(5\text{-}NO_2\text{-phen})]^{2+}$ | 114 | 110 |
| 7-1b (compar.) | 7-1 | not added | 100 | 100 |
| 7-2b (compar.) | 7-2 | $[Fe(CN)_6]^{4-}$ | 110 | 123 |
| 7-3b (compar.) | 7-3 | $[Fe(CN)_5(DMSO)]^{3-}$ | 111 | 119 |
| 7-4b (compar.) | 7-4 | $[Fe(CN)_5(\mu\text{-}4,4'\text{-bpy})]^{3-}$ | 114 | 125 |
| 7-5b (compar.) | 7-5 | $[Ru(CN)_5(MTP)]^{3-}$ | 122 | 115 |
| 7-6b (compar.) | 7-6 | $[Fe(EDTA)]^{2-}$ | 103 | 102 |
| 7-7b (invention) | 7-7 | $[Ru(thia)_6]^{2+}$ | 129 | 127 |
| 7-8b (invention) | 7-8 | $[Ru(pyz)_6]^{2+}$ | 97 | 96 |
| 7-9b (invention) | 7-9 | $[Ru(bpy)_2(4,4'\text{-bpy})_2]^{2+}$ | 106 | 104 |
| 7-10b (invention) | 7-10 | $[Ru(bpy)_2(4,4'\text{-bpy})Cl]^{-}$ | 118 | 117 |
| 7-11b (invention) | 7-13 | $[Ru(bpy)_2(5\text{-}NH_2\text{-phen})]^{2+}$ | 135 | 130 |
| 7-12b (invention) | 7-14 | $[Ru(bpy)_2(5\text{-}NO_2\text{-phen})]^{2+}$ | 131 | 127 |

*: As to the symbols given to the ligands of the foregoing dopants, DMSO stands for dimethyl sulfoxide, μ-4,4'-bpy for μ-4,4'-bipyridine, EDTA for ethylenediaminetetraacetic acid, MTP for 5-methyl-s-triazolo(1.5-A)-pyrimidine-7-ol, thia for thiazole, pyz for pyrazine, bpy for 2,2'-bipyridine, 4,4'-bpy for 4,4'-bipyridine, 5-$NH_2$-phen for 5-amino-1, 10-phenanthroline and 5-$NO_2$-phen for 5-nitro-1,10-phenanthroline.

*1: Samples having "a" as the suffix of their sample Nos. are sensitizing dye-free samples, and those having "b" are sensitizing dye-added samples. The former samples were exposed to light of wavelengths corresponding to the intrinsic absorption of silver bromide, while the latter samples were exposed to light of wavelengths at which the sensitizing dye showed absorption.

*2: Sensitivities shown as relative values, with Emulsion 4-1 being taken as 100 under each condition.

Preparation of Present Emulsions 7-7 to 7-12 (Octaheddral Silver Bromide Emulsions Doped with Present Complexes Respectively)

[Invention]

Emulsions 7-7 to 7-12 were prepared in the same manner as Emulsion 3-1, except that $[Ru(thia)_6]^{2+}$ (thia=thiazole), $[Ru(pyz)_6]^{2+}$ (pyz=pyrazine), $[Ru(bpy)_2(4,4'\text{-bpy})_2]^{2+}$ (bpy= 2,2'-bipyrizine, 4,4'-bpy =4,4'-bipyridine), $[Ru(bpy)_2(4,4'\text{-bpy})Cl]^{+}$, $[Ru(bpy)_2(5\text{-}NH_2\text{-phen})]^{2+}$ (5-$NH_2$-phen=5-amino-1,10-phenanthroline), and $[Ru(bpy)_2(5\text{-}NO_2\text{-phen})]$ 2+(5-$NO_2$-phen=5-nitro-1,10-phenanthroline) according to In Table 7 are set forth the relative sensitivities of the emulsions doped with the present complexes of the type which contained chargeless heterocyclic compounds having a moiety capable of interacting with $Ag^{+}$ as ligands. All the emulsions doped with the complexes, excepting $[Ru(pyz)_6]^{2+}$, had an increase in sensitivity under every condition, compared with the dopant-free emulsion. And the increase in sensitivity was greater in the case of dye-added samples than in the case of dye-free samples. This is because the intrinsic desensitization can be reduced by doping with these complexes. The sensitization effects achieved by using as dopants $[Ru(thia)_6]^{2+}$, $[Ru(bpy)_2(4,4'\text{-bpy})Cl]^+$, $[Ru(bpy)_2(5\text{-}NH_2\text{-phen})]^{2+}$ and $[Ru(bpy)_2(5\text{-}NO_2\text{-phen})]^{2+}$, respectively compared favorably with those obtained by the use of the dopants containing cyanide ions as ligands which have so far been used for increasing the photographic speed. On comparison of the sensitivity increasing effects produced by the complexes recited above, there were observed such orders that $[Ru(bpy)_2(4,4'\text{-bpy})_2]^{2+}<[Ru(bpy)_2(4,4'\text{-bpy})Cl]^+<[Ru(bpy)_2(5\text{-}NO_2\text{-phen})]_{2+}<[Ru(bpy)_2(5\text{-}NH_2\text{-phen})]_{2+}$. These orders indicate that there is no clear correlation between the tendency to adsorb to silver halide grains and the sensitivity increasing effect.

EXAMPLE 8

Preparation of Emulsion 8-1 (Octahedral Silver Bromide Emulsion Sample (2)

An Emulsion 8-1 was prepared in the same manner as Emulsion 3-1 prepared in Example 3.

Preparation of Comparative Emulsion 8-2 (Octahedral Silver Bromide Emulsion Doped with $[Fe(CN)_6]^{4-}$)

[Comparison]

An Emulsion 8-2 was prepared in the same manner as Emulsion 3-1, except that $[Fe(CN)_6]^{4-}$ was added to the Solution 10 in an amount of $1\times10^{-4}$ mole per mole of silver at the addition stage of this solution.

Preparation of Present Emulsions 8-3 to 8-7 (Otaheddral Silver Bromide Emulsions Doped with Present Complexes Respectively)

[Invention]

Emulsions 8-3 to 8-6 were prepared in the same manner as Emulsion 3-1, except that $[Ru(thia)_6]^{2+}$, $[Ru(pyz)_6]^{2+}$, $[Ru(bpy)_2(5\text{-}NH_2\text{-phen})]^{2+}$ and $[Ru(bpy)_2(5\text{-}NO_2\text{-phen})]^{2+}$ according to the present invention were added respectively to each of Solutions 9 and 10 in an amount of $1\times10^{-4}$ mole per mole of silver at the addition stage of each Solution.

The foregoing silver bromide Emulsions 8-1 to 8-6 were each chemically sensitized to the optimum and coated in the same manner as in Example 7, thereby preparing coated Samples 8-1a to 8-6a respectively. Further, the coated Samples 8-1b to 8-6b were prepared by spectrally sensitizing the foregoing chemically sensitized emulsions respectively by the addition of $4.9\times10^{-4}$ mole/mole-Ag of the same Sensitizing Dye (1) as used in Example 7, and coating the resulting emulsions respectively in the same manner as adopted for preparing the coated Samples 8-1a to 8-6a.

These Samples were each subjected to the exposure for sensitometry (1 second, $10^{-3}$ second) via an optical wedge, and then to the same photographic processing as in Example 7, followed by examination of optical densities. The fog and the sensitivity were determined similarly to those in Example 7. The sensitivity values were expressed as relative values, with the dopant-free Sample being taken as 100. With respect to the coated Samples 8-1a to 8-6a (spectral sensitizing dye-free samples), the sensitivity of each sample shown in Table 8 is relative sensitivity determined when the sample was exposed to light of wavelengths at which the silver halide therein showed the intrinsic absorption. On the other hand, the sensitivities of coated Samples 8-1b to 8-6b (spectral sensitizing dye-added samples) shown in Table 8 are relative sensitivities determined when the samples were exposed to light of wavelengths corresponding to the absorption by the spectral sensitizing dye.

TABLE 8

| Sample No.*1 | Emulsion No. | Dopant* | Relative Sensitivity*2 One-second exposure | Relative Sensitivity*2 $10^{-3}$-second exposure |
|---|---|---|---|---|
| 8-1a (compar.) | 8-1 | Not added | 100 | 100 |
| 8-2a (compar.) | 8-2 | $[Fe(CN)_6]^{4-}$ | 102 | 104 |
| 8-3a (invention) | 8-3 | $[Ru(pyz)_6]^{2+}$ | 116 | 109 |
| 8-4a (invention) | 8-4 | $[Ru(thia)_6]^{2+}$ | 115 | 112 |
| 8-6a (invention) | 8-6 | $[Ru(bpy)_2(5\text{-}NH_2\text{-phen})]^{2+}$ | 119 | 115 |
| 8-7a (invention) | 8-7 | $[Ru(bpy)_2(5\text{-}NO_2\text{-phen})]^{2+}$ | 116 | 114 |
| 8-1b (compar.) | 8-1 | not added | 100 | 100 |
| 8-2b (compar.) | 8-2 | $[Fe(CN)_6]^{4-}$ | 110 | 123 |
| 8-3b (invention) | 8-3 | $[Ru(pyz)_6]^{2+}$ | 125 | 124 |
| 8-4b (invention) | 8-4 | $[Ru(thia)_6]^{2+}$ | 135 | 131 |
| 8-6b (invention) | 8-6 | $[Ru(bpy)_2(5\text{-}NH_2\text{-phen})]^{2+}$ | 148 | 141 |
| 8-7b (invention) | 8-7 | $[Ru(bpy)_2(5\text{-}NO_2\text{-phen})]^{2+}$ | 143 | 135 |

*: As to the symbols given to the ligands of the foregoing dopants, thia stands for thiazole, pyz for pyrazine, bpy for 2,2'-bipyridine, 5-$NH_2$-phen for 5-amino-1,10-phenanthroline and 5-$NO_2$-phen for 5-nitro-1,10-phenanthroline.

*1: Samples having "a" as the suffix of their sample Nos. are sensitizing dye-free samples, and those having "b" are sensitizing dye-added samples. The former samples were exposed to light of wavelengths corresponding to the intrinsic absorption of silver bromide, while the latter samples were exposed to light of wavelengths at which the sensitizing dye showed absorption.

*2: Sensitivities shown as relative values, with Emusion 4-1 beinq taken as 100 under each condition.

In Table 8 are set forth the relative sensitivities of the emulsions wherein each of the present complexes uniformly doped throughout the grains, excepting the part acting as nuclei upon grain formation. Similarly to the case of Example 7 wherein the present complexes were added to the grain surface layer alone, each doped emulsion showed higher sensitivity than the undoped emulsion. In such a case of uniformly doping throughout the grains, even the emulsion doped with $[Ru(pyz)_6]^{2+}$ acquired high sensitivity. The present complexes brought the emulsion having a greater increase of sensitivity in the case of uniformly doping throughout the grains than in the case of doping the grain surface layer alone, and the sensitivity increase brought thereby was especially great when the sensitizing dye was added to the emulsion.

EXAMPLE 9

Preparation of Emulsion 9-1 (Cubic Silver Bromide Emulsion)

A cubic silver bromide Emulsion 9-1 was prepared in the same manner as Emulsion 3-1 prepared in Example 3, except that each of Solutions 9 and 10 was added while controlling so as to keep the pBr at 4.66. The emulsion grains obtained therein were monodispersed silver bromide cubes having an edge length of 0.5 μm.

Preparation of Present Emulsions 9-2 and 9-3 (Cubic Silver Bromide Emulsions Doped with Present Complexes, $[Ru(pyz)_6]^{2+}$ and $[Ru(thia)_6]^{2+}$, Respectively)

[Invention]

Emulsions 9-2 and 9-3 were prepared in the same manner as Emulsion 9-1, except that $[Ru(pyz)_6]^{2+}$ and $[Ru(thia)_6]^{2+}$ according to the invention were added respectively to Solution 10 in an amount of $1\times10^{-4}$ mole per mole of silver at the addition stage of this solution.

Each of the silver bromide Emulsions 9-1 to 9-3 was admixed with $1.2\times10^{-4}$ mole/mole-Ag of sodium thiosulfate, and subjected to optimal chemical sensitization at 60° C. Further, each of these chemically sensitized emulsions was spectrally sensitized by the addition of $4.9\times10^{-4}$ mole/mole-Ag of the sameeSensitizing Dye (1) as used in Example 1. After admixed with gelatin and sodium dodecylbenzenesulfonate, each of these chemically and spectrally sensitized emulsions was coated at a silver coverage of 2 g/m$^2$ using an extrusion method on a subbing layer-provided triacetyl cellulose film support together with a protective layer containing gelatin, polymethylmethacrylate particles and sodium salt of 2,4-dichloro-6-hydroxy-s-triazine. Thus, coated Samples 9-1 to 9-3 were prepared These Samples were each subjected to the exposure for sensitometry (1 second and 10 seconds) via an optical wedge, and then developed for 10 minutes at 20° C. with Developer 1. Thereafter, each Sample underwent sequentially stop, fixation, washing and drying operations, and then measured for optical densities. The fog density was determined as the minimum optical density of each sample, and the sensitivity was represented by the logarithm of an exposure amount required for providing the optical density of fog+0.1. The sensitivities of Samples are shown as relative values in Table 9, with the dopant-free Sample being taken as 100. The sensitivity of each coated sample (sensitizing dye-added sample) shown in Table 9 are relative sensitivities determined when the sample was exposed to light of wavelengths corresponding to the absorption by the spectral sensitizing dye.

TABLE 9

| Sample No. | Emulsion No. | Dopant* | Relative Sensitivity*[1] One-second exposure | Relative Sensitivity*[1] $10^{-3}$-second exposure |
|---|---|---|---|---|
| 9-1 (compar.) | 9-1 | not added | 100 | 100 |
| 9-2 (invention) | 9-2 | $[Ru(pyz)_6]^{2+}$ | 113 | 111 |
| 9-3 (invention) | 9-3 | $[Ru(thia)_6]^{2+}$ | 114 | 113 |

*As to the symbols given to the ligands of the foregoing dopants, pyz stands for pyrazine and thia for thiazole.
*[1]Sensitivities shown as relative values, with Emulsion 9-1 being taken as 100 under each condition.

In Table 9 are set forth the relative sensitivities of the cubic silver bromide emulsions doped with the present complexes $[Ru(pyz)_6]^{2+}$ and $[Ru(thia)_6]^{2+}$, respectively. Each dopant was added to the surface layer having a volume corresponding to 10% of the total volume of each emulsion grain. As can be seen from Table 9, these doped emulsions had high sensitivities, as compared with the undoped emulsion. This is because they functioned so as to reduce the intrinsic desensitization similarly to the doped octahedral silver bromide emulsions.

EXAMPLE 10

Preparation of Emulsion 10-1 (Emulsion Sample (1) Comprising Tabular Silver Iodobromide Grains Having (111) Face as Main Plane)

An Emulsion 10-1 was prepared in the same manner as Emulsion 6-1 prepared in Example 6.

Preparation of Comparative Emulsion 10-2 (Tabular Iodobromide Silver Emulsion Doped with $[Ru(CN)_6]^{4-}$)

[Comparison]

A comparative Emulsion 10-2 was prepared by doping Emulsion 6-1 by the addition of $[Ru(CN)_6]^{4-}$ in an amount of $1\times10^{-4}$ mole per mole of silver contained in the total emulsion grains so that each emulsion grain was doped with the foregoing complex in the region corresponding to 80–100% of its volume.

Preparation of Present Emulsions 10-3 to 10-4 (Tabular Iodobromide Silver Emulsions Doped with Present Complexes Respectively)

[Invention]

Emulsions 10-3 to 10-4 according to the present invention were prepared by doping Emulsion 6-1 by the addition of $[Ru(thia)_6]^{2+}$, and $[Ru(bpy)_2(5\text{-}NH_2\text{-phen})]^{2+}$ in amounts of $1\times10^{-5}$ mole, $1\times10^{-4}$ mole and $1\times10^{-4}$ mole, respectively, per mole of silver contained in the total emulsion grains so that each emulsion grain was doped with the foregoing complex in the region corresponding to 80–100% of its volume.

Each of the Emulsions 10-1 to 10-4 was admixed with $8.0\times10^{-6}$ mole/mole-Ag of sodium thiosulfate, $3\times10^{-6}$ mole/mole-Ag of chloroauric acid and $3\times10^{-6}$ mole/mole-Ag of potassium thiocyanate, and subjected to optimal chemical sensitization at 60° C. Each of these chemically sensitized emulsions was coated in the same manner as in Example 7 to prepare the coated Samples 10-1 to 10-4.

These samples were each subjected to the exposure for sensitometry ($10^{-2}$ second) via an optical wedge, and then developed in the same manner as in Example 7, and further subjected to conventional stop, fixation, washing and drying operations, followed by examination of optical densities In Table 10 are set forth the relative sensitivities of the coated Samples 10-1 to 10-4 (spectral sensitizing dye-free samples) which were determined by exposure to light of wavelengths at which the silver halide therein showed the intrinsic absorption.

TABLE 10

| Sample No. | Emulsion No. | Dopant* | Amount added (mol/mol Ag) | Relative sensitivity*[1] ($10^{-2}$-second exposure) |
|---|---|---|---|---|
| 10-1 (compar.) | 10-1 | not added | — | 100 |
| 10-2 (compar.) | 10-2 | $[Ru(CN)_6]^{4-}$ | $1\times10^{-4}$ | 105 |
| 10-3 (invention) | 10-3 | $[Ru(thia)_6]^{2+}$ | $1\times10^{-5}$ | 118 |

TABLE 10-continued

| Sample No. | Emulsion No. | Dopant* | Amount added (mol/mol Ag) | Relative sensitivity*[1] ($10^{-2}$-second exposure) |
|---|---|---|---|---|
| 10-4 (invention) | 10-5 | $[Ru(bpy)_2(5\text{-}NH_2\text{-phen})]^{2+}$ | $1 \times 10^{-4}$ | 127 |

*As to the symbols given to the ligands of the foregoing dopants, thia stands for thiazole, bpy for 2,2'-bipyridine, and 5-$NH_2$-phen for 5-amino-1, 10-phenanthroline.
*[1]Sensitivities shown as relative values, with Emulsion 10-1 being taken as 100 under each condition.

All the emulsions doped with the complexes of the present invention had higher sensitivity than the emulsion doped with $[Ru(CN)_6]^{4-}$. Further, in contrast to the comparative emulsions, the present doped emulsions had greater sensitivity increasing effect in the high exposure region than the low exposure region of the characteristic curve, so the dope with the present complexes gave high contrast to the emulsion In addition, the maximum densities provided by the emulsions doped with the present complexes were higher than that provided by the emulsion doped with $[Ru(CN)_6]^{4-}$.

EXAMPLE 11

The same emulsion as Emulsion 10-4 prepared in Example 10, namely the tabular iodobromide emulsion having (111) face as main plane and doped with $[Ru(bpy)_2(5\text{-}NH_2\text{-phen})]^{2+}$, was chemically sensitized to the optimum, and then spectrally sensitized. Then, the thus sensitized emulsion was used as the emulsion for the third layer of the sensitive material prepared as Sample No. 201 in Example 2 of. JP-A-9-146237, and subjected to the same processing as in Example 2 of the foregoing gazette, thereby producing good results.

EXAMPLE 12

The same emulsions as Emulsions 6-2 to 6-5 prepared in Example 6, namely the tabular iodobromide emulsion s having (111) face as main plane and doped with $[Ru(trz)_6]^{4-}$, $[Ru(Hdpa)_3]^{2+}$ and $[Ru(hq)_3]^{-}$ respectively, were each chemically sensitized to the optimum, and then spectrally sensitized.

Then, each of the thus sensitized emulsions was used as the emulsion for the 3rd layer of the sensitive material prepared as Sample No. 110 in Example 1 of JP-A-10-20462, and subjected to the same processing as in Example 2 of the foregoing gazette, thereby producing good results.

EFFECT OF THE INVENTION

In accordance with the present invention, the complex having organic ligands (especially heterocyclic ligands) at a majority of coordination sites of the central metal ion, wherein some of the organic ligands have a moiety capable of interacting with another metal ion in addition to a coordination atom, or the complex using the organic ligands having a moiety capable of having a negative charge, is added to a silver halide emulsion, thereby producing significant improvements in photographic characteristics.

While the invention has been described in detail and with reference to specific embodiments thereof, it will be apparent to one skilled in the art that various changes and modification can be made therein without departing from the sprit and scope thereof.

What is claimed is:

1. A silver halide photographic material comprising a support having thereon at least one silver halide emulsion layer, wherein said silver halide emulsion comprises a metal complex in which a majority of coordination sites of the metal ion is occupied by organic ligands containing a chain or cyclic hydrocarbon as a parent compound, or organic ligands in which carbon atoms or hydrogen atoms in the chain or cyclic hydrocarbon as a parent compound are partially replaced by other atoms or atomic groups.

2. The silver halide photographic material according to claim 1, wherein the silver halide emulsion contains the metal complex in silver halide grains.

3. The silver halide photographic material according to claim 1, wherein the complex is represented by the following formula (I), (II) or (III):

$$[ML_nX_{(C-n)}]^z \quad \text{(I)}$$

$$[ML'_mX_{(C-2m)}]^z \quad \text{(II)}$$

$$[ML''_2]^z \quad \text{(III)}$$

wherein M represents a metal or a metal ion; L, L' and L" each represent a ligand having as its basic structure a chain or cyclic hydrocarbon whose carbon atoms or hydrogen atoms are partially replaced by other atoms or atomic groups, provided that L represents a monodentate ligand, L' represents a bidentate ligand and L" represents a tridentate ligand, wherein the ligands represented by L, L' and L" may be either the same or different from each other; X represents arbitrary ligands; C is 4 or 6, and when C is 6, n is 4, 5 or 6 and m is 2 or 3, while when C is 4, n is 3 or 4 and m is 2; and z represents an integer of from −6 to +4.

4. The silver halide photographic material according to claim 3, wherein one or more ligands each containing at least one negatively charged moiety formed by a dehydrogenation occupy a majority of the metal coordination site in the complex represented by formula (I), formula (II) or formula (III).

5. The silver halide photographic material according to claim 3, wherein one or more ligands each containing at least one coordination site in addition to the site bonding the central metal ion occupy a majority of the metal coordination sites in the complex represented by formula (I), formula (II) or formula (III).

6. The silver halide photographic material according to claim 4, wherein the ligand represented by L in formula (I), L' in formula (II) or L" in formula (III) is comprised of a 5- or 6-membered heterocyclic ring.

7. The silver halide photographic material according to claim 5, wherein the ligand represented by L in formula (I), L' in formula (II) or L" in formula (III) is comprised of a 5- or 6-membered heterocyclic ring.

8. The silver halide photographic material according to claim 6, wherein the heterocyclic moiety containing L in formula (I) or L' in formula (II) is selected from pyrrole, pyrazole, imidazole, 1,2,3-triazole, 1,2,4-triazole, tetrazole and 2,2'-biimidazole moieties.

9. The silver halide photographic material according to claim 7, wherein the heterocyclic moiety containing L in formula (I) or L' in formula (II) is selected from oxazoline, oxazole, isoxazole, thiazoline, thiazole, isothiazole, thiadiazole, furazan, pyridazine, pyrimidine, pyrazine, triazine, oxadiazine, thiadiazine and dithiazine moieties.

10. The silver halide photographic material according to claim 4, wherein the negatively charge moiety formed by a dehydrogenation in the ligand L in formula (I), L' in formula (II) or L" in formula (III) is onto a substituent bonding to an aromatic ring.

11. The silver halide photographic material according to claim 5, wherein the coordination site in the ligand L in formula (I), L' in formula (II) or L" in formula (III) is onto a substituent bonding to an aromatic ring.

12. The silver halide photographic material according to claim 10, wherein the substituent in the ligand L in formula (I), L' in formula (II) or L" in formula (III) is selected from the group consisting of an alcohol, carboxylic acid, peroxy acid, sulfonic acid, sulfinic acid, sulfenic acid, nitro group, isocyanide, hydroperoxide, amidocarboxylic acid, azoxy group, azohydroxide, hydroxylamine and oxime.

13. The silver halide photographic material according to claim 11, wherein the substituent in the ligand L in formula (I), L' in formula (II) and L" in formula (III) is selected from the group consisting of amine, imine, hydrazine, ketone, aldehyde, ether, ester, peroxide, acid anhydride, acid halide, amide, hydrazide, imide, nitrile, cyanic acid ester, thiocyanic acid ester, nitro group, nitroso group, alkyl nitrate, alkyl nitrite, acylamine and nitrile oxide.

14. The silver halide photographic material according to claim 12, wherein the aromatic moiety bonding the negative charged substituent formed by a dehydrogenation in the ligand L in formula (I), L' in formula (II) or L" in formula (III) is selected from furan, thiophene, pyran, pyridine, benzene, 2,2'-bithiophene, 2,2'-bipyridine and 2,2':6',2"-terpyridine moieties.

15. The silver halide photographic material according to claim 13, wherein the aromatic moiety bonding the substituent as coordination site in the ligand L in formula (I), L' in formula (II) or L" in formula (III) is selected from furan, thiophene, pyran, pyridine, benzene, 2,2'-bithiophene, 2,2'-bipyridine and 2,2':6',2"-terpyridine moieties.

16. The silver halide photographic material according to claim 3, wherein the metal ion represented by M is magnesium, cobalt, iron, ruthenium or zinc ion.

17. The silver halide photographic material according to claim 3, wherein the ligands represented by X in formulae (I) and (II) each is $H_2O$, $NH_3$ or a monovalent anion.

* * * * *